US005517281A

United States Patent [19]

Miyashiro et al.

[11] Patent Number: 5,517,281

[45] Date of Patent: May 14, 1996

[54] IMAGE FORMING APPARATUS FEATURING A PLURALITY OR RELATIVELY MOVEABLE CASINGS

[75] Inventors: Toshiaki Miyashiro, Machida; Shinkichi Takahashi, Yokohama; Takao Aoki, Abiko; Eihiro Sakaki, Chofu; Fumihiro Ueno, Yokohama, all of Japan

[73] Assignee: Canon Kabushiki Kaisha, Tokyo, Japan

[21] Appl. No.: 418,998

[22] Filed: Apr. 7, 1995

Related U.S. Application Data

[63] Continuation of Ser. No. 137,815, Oct. 19, 1993, abandoned, which is a continuation of Ser. No. 899,241, Jun. 16, 1992, abandoned.

[30] Foreign Application Priority Data

Jun. 19, 1991 [JP] Japan ..... 3-173416
May 27, 1992 [JP] Japan ..... 4-135053

[51] Int. Cl.[6] ..... G03G 15/00; G03G 21/00

[52] U.S. Cl. ..... 355/200

[58] Field of Search ..... 355/200, 210, 355/211, 212

[56] References Cited

U.S. PATENT DOCUMENTS

| | | | |
|---|---|---|---|
| 4,384,781 | 5/1983 | Takada | 355/290 |
| 4,412,734 | 11/1983 | Shibuya et al. | 355/309 |
| 4,575,221 | 3/1986 | Onoda et al. | 355/200 |
| 4,674,859 | 6/1987 | Iseki et al. | 355/279 |
| 4,727,395 | 2/1988 | Oda et al. | 355/270 X |
| 4,803,510 | 2/1989 | Maeda | 355/210 |
| 4,806,970 | 2/1989 | Nakatomi et al. | 355/282 |
| 5,045,887 | 9/1991 | Nakamura | 355/200 X |
| 5,086,318 | 2/1992 | Takeda et al. | 355/271 |

FOREIGN PATENT DOCUMENTS

| | | | |
|---|---|---|---|
| 2-262675 | 10/1990 | Japan | 355/210 A |
| 3-72376 | 3/1991 | Japan | 355/210 A |
| 3-83077 | 4/1991 | Japan | 355/210 A |

*Primary Examiner*—Fred L. Braun
*Attorney, Agent, or Firm*—Fitzpatrick, Cella, Harper & Scinto

[57] ABSTRACT

An image forming apparatus for forming an image on a recording medium has an image forming device for forming an image on the recording medium, a conveyance path for conveying the recording medium so that an image is formed by the image forming device, a first casing having a portion of the conveyance path, a second casing having a portion of the conveyance path and being openable relative to the first casing, and a third casing having a portion of the conveyance path and being openable relative to the second casing. The relatively openable casings, each having a portion of the conveyance path, provide an image forming apparatus in which a jam can be dealt with easily.

36 Claims, 19 Drawing Sheets

IMAGE FORMING APPARATUS FEATURING A PLURALITY OR RELATIVELY MOVEABLE CASINGS

This application is a continuation of application Ser. No. 08/137,815 filed Oct. 19, 1993, now abandoned which is a continuation of application Serial No. 07/899,241 filed Jun. 16, 1992, now abandoned.

BACKGROUND OF THE INVENTION

1. Field of the Invention

The present invention relates to an image forming apparatus for forming images on recording media.

Examples of image forming apparatuses include an electrophotographic copying machine, a laser beam printer, a work processor, a facsimile equipment and the like.

2. Description of the Related Art

A color image forming apparatus is described below as an example of image forming apparatuses.

Conventional color image forming apparatuses frequently employ an electrophotographic system using multiple transfer, as shown in FIG. 21. In this example, an image holding member 3 serving as an electrophotographic photosensitive drum is supported so as to be rotatable in the direction of an arrow. The photosensitive drum 3 is uniformly charged by charge means H and then irradiated with light by a laser exposure device L to form an electrostatic latent image on the photosensitive drum 3. The latent image is changed to a visible image, i.e, a toner image, by a development device 1 which contains color developers of, for example, yellow (Y), magenta (M), cyan (C), black (BK) and the like.

On the other hand, a transfer material 7 is conveyed so as to be fixed to the surface of a transfer device 2, for example, in a drum-like form, by electrostatic adsorption or means such as a gripper or the like. The color image on the photosensitive drum 3 is transferred to the transfer material 7 wound on the transfer device 2, i.e., a transfer drum in this example.

This example is further described below. The electrostatic latent image formed on the photosensitive drum 3 by exposure based on a image signal of a first color is first visualized by a development unit 1*a* containing, for example, a yellow (Y) developer, and then transferred to the transfer material 7 held on the transfer drum 2. After the developer remaining on the photosensitive drum 3 is cleaned off by a cleaner 4, an electrostatic latent image of a second color is formed on the photosensitive drum 3 by exposure based on an image signal of the second color and is visualized by a development unit 1*b* containing, for example, a magenta (M) developer. The resultant visual image is then overlapped on the first visible image of yellow transferred to the transfer material 7 on the transfer drum 2 and transferred thereto. Toner images of third and fourth colors, for example, cyan (C) and black (BK), respectively, are then overlapped and transferred to the transfer material 7 on the transfer drum 2 by repeating the above-described process. The transfer material 7 is then separated from the transfer drum 2 by a separation device 6, and the color images are fixed by a fixing device 5 to obtain a permanent image.

In the above-described color image forming apparatus using a multiple transfer process, defective feeding of the transfer material 7, i.e., a jam, frequently occurs in holding area a where the transfer material 7 is held by the transfer drum 2 and separation area b where the transfer material 7 is separated from the transfer drum 2, both areas being shown as shadowed portions in FIG. 21.

When the leading end of the transfer material 7 separated from the transfer drum 2 in the separation area b has already been conveyed to the fixing device 5, there is sometimes the danger of producing a complicated jam, i.e., a jam of the transfer material 7 over the range from the fixing device 5 and the transfer drum 2.

In conventional apparatuses, when such a jam occurs, one side (the side shown in the drawing) of the apparatus body is opened, the transmission of driving to the transfer drum 2 is manually released, and the transfer material 7 causing defective conveyance is pulled out to the side of the body while the transfer drum 2 is manually rotated.

However, in the above-described method of dealing with a jam in the conventional apparatuses, since the transfer drum 2 and the photosensitive drum 3 must be manually rotated for puling out the transfer material 7 wound on the transfer drum 2, the work is troublesome. Further, since the jammed transfer material 7 is removed in the direction perpendicular to the direction of conveyance of the transfer material 7, there is produced the problem that the surface of the transfer drum 2 is rubbed with the transfer material 7 and damaged thereby.

SUMMARY OF THE INVENTION

It is an object of the present invention to provide an image forming apparatus which enables easy maintenance.

It is another object of the present invention to provide an image forming apparatus which enables a jam to be easily dealt with.

It is still another object of the present invention to provide an image forming apparatus which is capable of obtaining high-quality images.

It is a further object of the present invention to provide an image forming apparatus which enables a jam to be easily dealt with and which can prevent damage to the apparatus body during dealing with a jam.

It is a still further object of the present invention to provide an image forming apparatus which can prevent the surface of the apparatus from being damaged during dealing with a jam and unfixed developer from being scattered by breakage of the jammed transfer material, and which is capable of obtaining high-quality images.

DETAILED DESCRIPTION OF THE PREFERRED EMBODIMENTS

Image forming apparatuses in accordance with preferred embodiments of the present invention are described in detail below with reference to the drawings.

Figure 1:
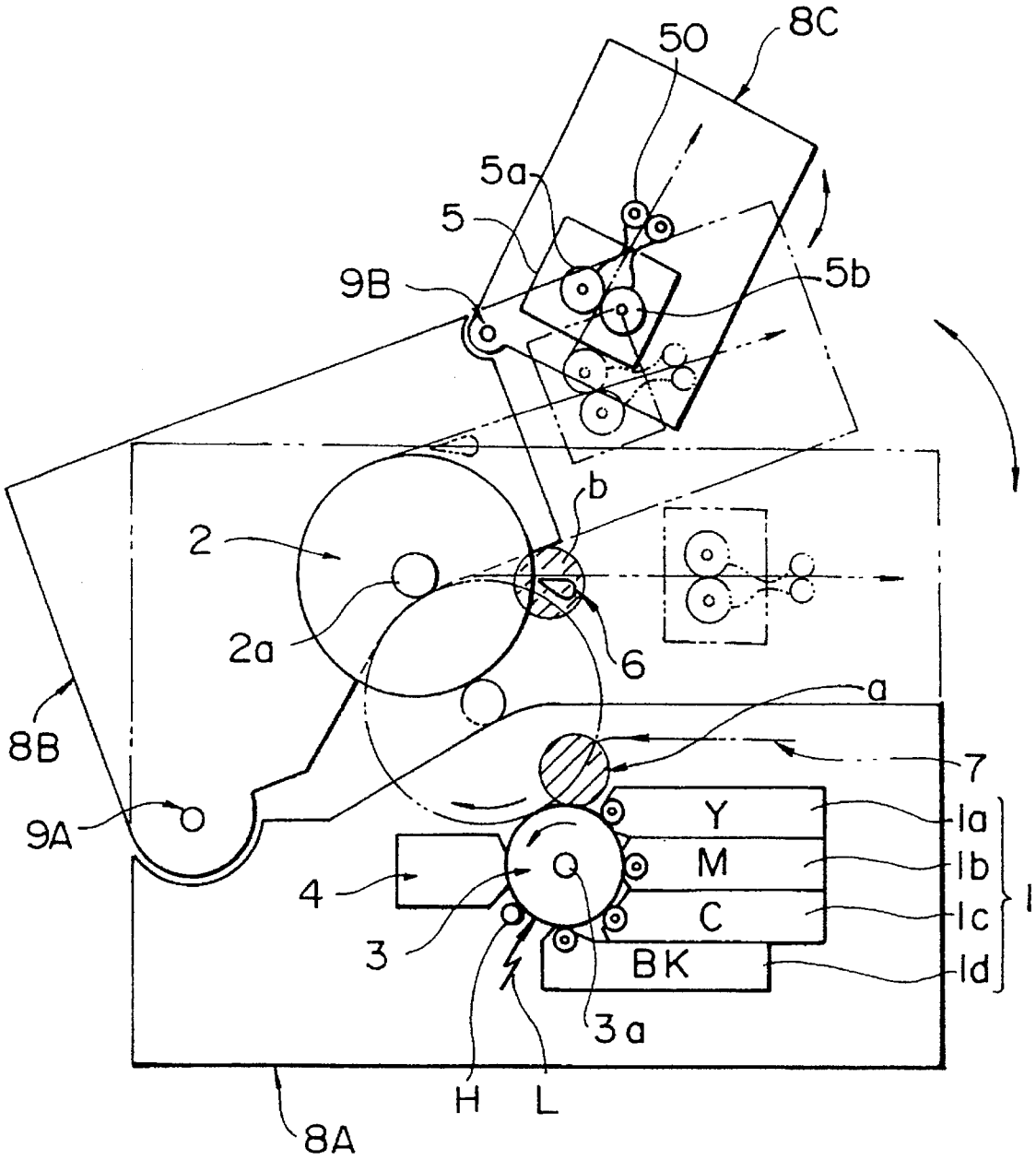
FIG. 1 is a sectional side view of a color image forming an apparatus in accordance with an embodiment of the present invention.

FIG. 1 shows an electrophotographic type color image forming apparatus as an embodiment of the image forming apparatus of the present invention. This color image forming apparatus has the same construction as that of the above-described conventional color image forming apparatus in which an image supporting member 3 serving as an electrophotographic photosensitive drum is supported so as to be rotatable in the counterclockwise direction shown by an arrow and is uniformly charged by roller charging means H. The photosensitive drum 3 is then irradiated with light L by a laser exposure device (not shown) to form an electrostatic latent image on the photosensitive drum 3. The latent image is changed to a visible image, i.e., a toner image, by development units 1 (1*a*, 1*b*, 1*c*, 1*d*) respectively containing color developers of yellow (Y), magenta (M), cyan (C), black (BK) and the like. In FIG. 1, reference numeral 3*a* denotes the rotational shaft of the photosensitive drum 3 serving as an image supporting member.

Figure 2:
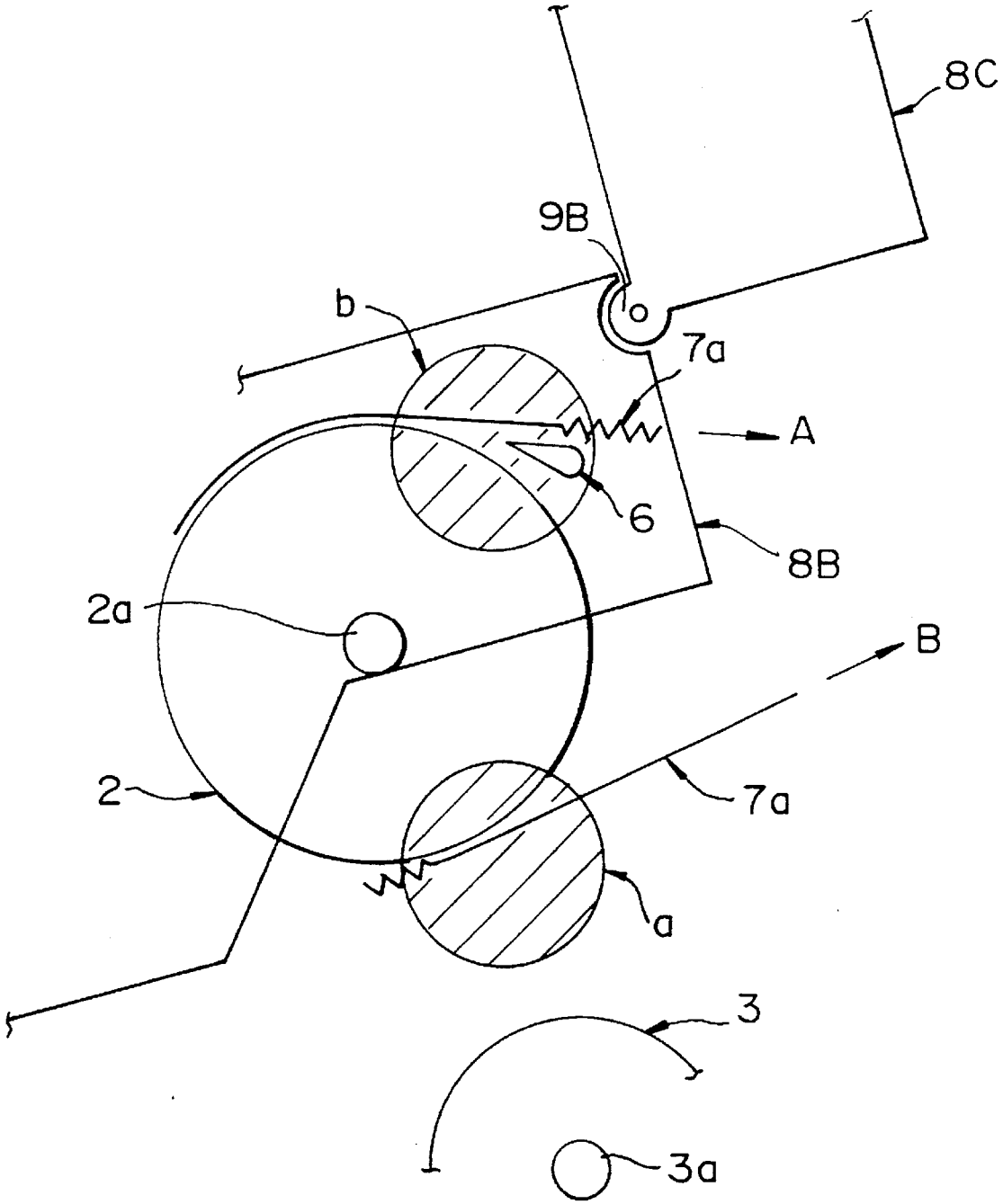
FIG. 2 is an enlarged side view of the one surrounding a transfer drum.

On the other hand, a transfer material 7 is conveyed while being fixed to the surface of a drum-like transfer device 2 by electrostatic adsorption or means such as a gripper (not shown) or the like. The color image formed on the photosensitive drum 3 is subjected to multiple transfers to the transfer material 7 wound on the transfer drum 2. FIG. 2 is an enlarged side view of the surroundings of the transfer drum 2.

The apparatus is further described below. The electrostatic latent image formed on the photosensitive drum 3 by exposure based on an image signal of a first color is visualized by the development unit 1*a* containing, for example, a yellow (Y) developer, and then transferred to the transfer material 7 supported on the transfer drum 2. After the developer remaining on the photosensitive drum 3 is cleaned off by a cleaner 4, an electrostatic latent image of a second color is formed on the photosensitive drum 3 by exposure based on an image signal of the second color, visualized by the development unit 1*b* containing, for example, a magenta (M) developer, and then transferred to the transfer material 7 having the yellow visual image of the first color transferred thereto so as to be overlapped thereon. Toner images of, for example, cyan (C) of a third color and black (BK) of a fourth color, are then transferred to the transfer material 7 on the transfer drum 2 so as to be overlapped thereon by repeating the same method as that described above. The transfer material 7 is then separated from the transfer drum 2 by a separation device 6, and the color image is fixed by a fixing device 5 to obtain a permanent image.

In the color image forming apparatus in which multiple transfer is performed, defective conveyance of the transfer material 7 frequently occurs in supporting area a where the transfer material 7 is supported by the transfer drum 2, and separation area b where the transfer material 7 is separated from the transfer drum 2 by a separation claw 6, both areas being shown as shadowed portions in FIG. 1. When a jam occurs in the above areas a or b, in some cases, the jammed transfer material 7 is partially held between the transfer drum 2 and the photosensitive drum 3 or the fixing device 5.

In this embodiment, the apparatus body is divided into a lower casing (or stationary first casing or portion, or development casing) 8A, an upper casing (or second casing or portion, or transfer casing) 8B and a fixing portion casing (or third casing or portion) 8C in order to deal with a jam. The upper casing 8B and the fixing portion casing 8C can be rotated about a first hinge 9A and a second hinge 9B, respectively, both of which have rotational shafts intersecting the direction of conveyance of the transfer material 7 at right angles, and can be opened relative to the lower casing 8A. That is to say, the upper casing 8B is rotated about the first hinge 9A so as to be vertically opened relative to the lower casing 8A, i.e., they are opened like a crocodile's open jaw. In addition, the fixing portion casing 8C is upwardly rotated about the second hinge 9B relative to the upper casing 8*b* so as to be opened relative to the lower casing 8A, i.e., they are opened like a crocodile's open jaw. The fixing portion casing 8C is provided with a fixing device 5 (for example, a heat-fixing device comprising heating rollers 5*a* and pressure rollers 5*b*) and discharge rollers 50.

In addition, in this embodiment, when the lower casing 8A and the upper casing 8B or the fixing portion casing 8C are opened by rotation about the first hinge 9A or the second hinge 9B, the driving of the transfer drum 2 is cut off in linkage to the opening operation. Methods that can be used as a mechanism for cutting off the driving include a method of separating the driving gear of the transfer drum 2 from the gear on the side of a driving section comprising a motor or the like during the opening of the apparatus body, a method of providing a switch which is turned on and off in linkage to the opening operation so that the an electromagnetic clutch provided between the switch and the transfer drum 2 is turned on and off in correspondence with the on and off states of the switch.

This construction brings the transfer drum 2 into the state wherein it can be rotated about the rotational shaft 2*a* during dealing with a jam. For example, when the transfer material 7 is jammed in the supporting area a, the upper casing 8B is opened relative to the lower casing 8A about the hinge 9A like a crocodile's open jaw, whereby the jammed transfer material 7 can be easily removed.

On the other hand, when a jam occurs in the separation area b, the upper casing 8B is opened about the first hinge 9A relative to the lower casing 8A, as described above, and the fixing portion casing 8C is rotated about the second hinge 9B relative to the upper casing 8B so as to be opened relative to the lower casing 8A, whereby the same operation as that described above can be carried out. Since the driving of the transfer drum 2 is cut off during dealing with a jam, the transfer drum 2 can be rotated about the rotational shaft 2*a*.

The construction of the embodiment enables a jam to be dealt with only by pulling out an end of the transfer material 7 in the direction of arrow A or B shown in FIG. 2, i.e., in the peripheral direction of the transfer drum 2, even if the transfer material 7 is partially held by the transfer drum 2 by electrostatic adsorption thereon.

In addition, when the fixing device 5 comprises a pair of fixing rollers 5*a*, 5*b* which are opposed at predetermined pressure, as in this embodiment, the transfer material 7 jammed in the separation area b is sometimes partially held by the fixing device 5. In this case, the leading end of the transfer material 7 held is released by rotating the rollers of the fixing device 5 in the reverse direction or by releasing the pressure between rollers, and one end of the transfer material 7 is then pulled out in the peripheral direction of the transfer drum 2 in the same manner as the above-described manner of dealing with a jam.

Figure 3:
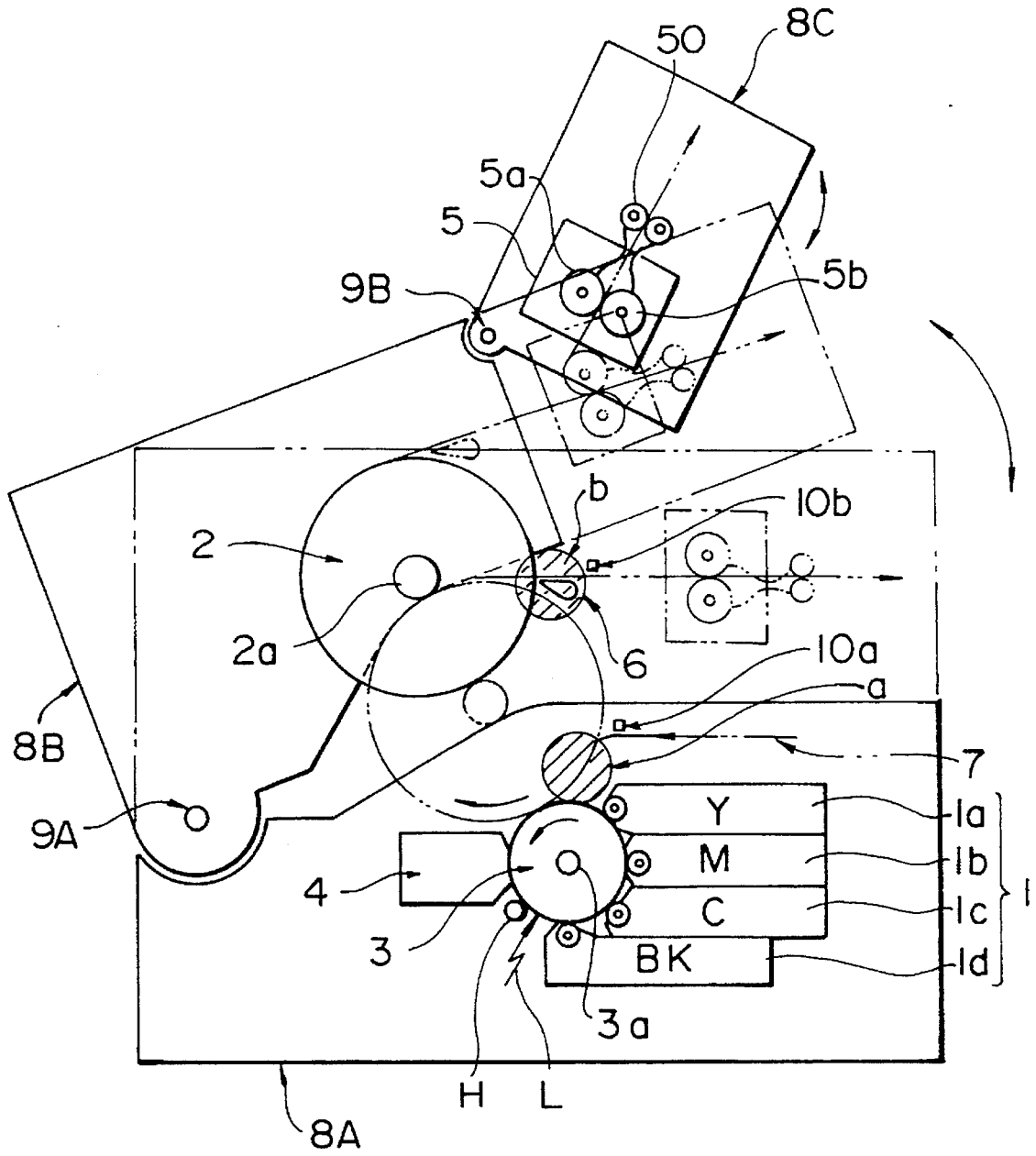
FIG. 3 is a sectional side view of a color image forming apparatus in accordance with an embodiment of the present invention.

FIG. 3 shows another embodiment of the present invention. In this embodiment, a first sensor 10a and a second sensor 10*b* are disposed at an upstream position and a downstream position, respectively, on the conveyance passage in a transfer drum 2 so as to detect the state of conveyance of the transfer material 7.

Each of the sensors 10*a*, 10*b* functions to detect the presence of the transfer material 7 on the conveyance passage, and an optical sensor comprising combination of a light emitting element such as a light emitting diode, or the like, and a light receiving element such as a phototransistor, or the like, or a mechanical sensor such as a microswitch, or the like, is used as the sensors 10*a*, 10*b*. For example, if the apparatus is configured so that a signal is output only when the transfer material 7 is present on the conveyance passage thereof, the time a sensor outputs a signal during normal conveyance is the time taken from the passage of the leading end of the transfer material 7 through a certain point of the apparatus body to the passage of the trailing end therethrough when the transfer material 7 conveyed is longest among transfer materials handled by the apparatus. If a signal is output from the sensor for a time longer than the above time, it is thus decided that the transfer material 7 is jammed on the passage of conveyance thereof.

Figure 5:
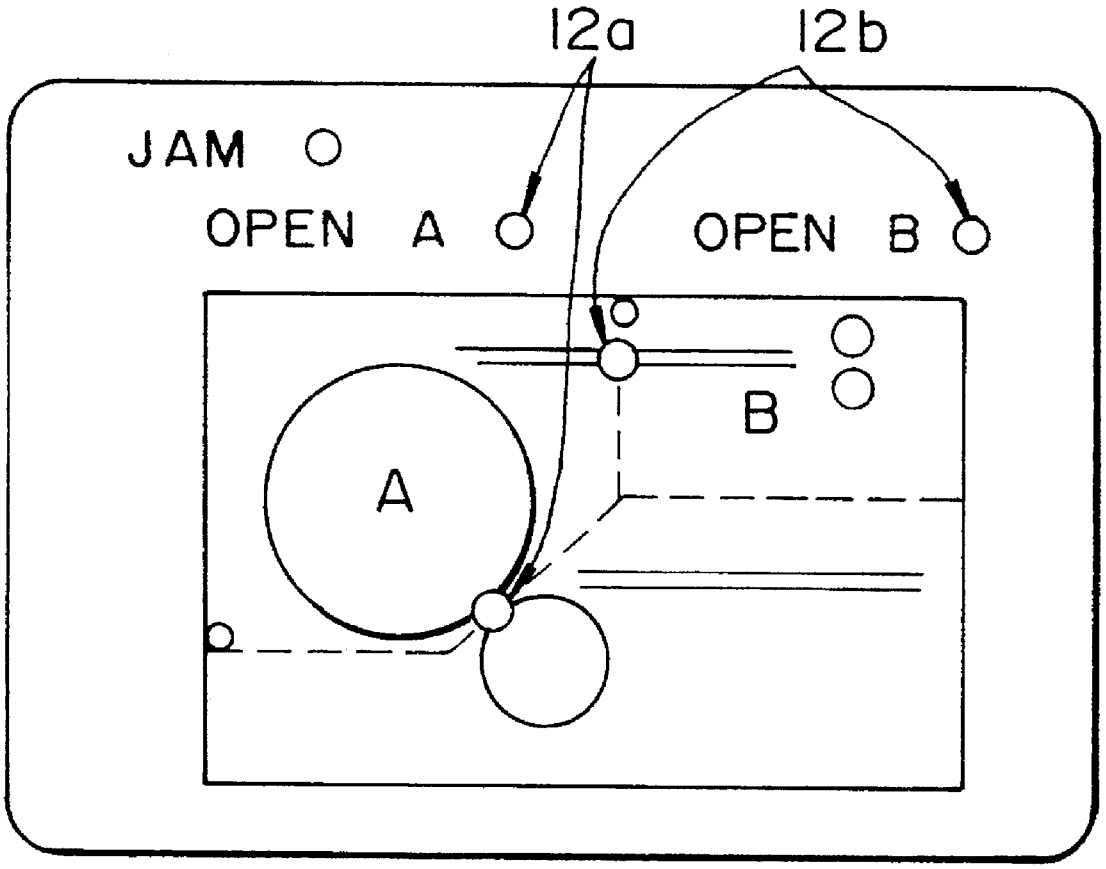
FIG. 5 is a plan view of a jam display panel.

This embodiment uses a jam detection mechanism, for example, having the display panel shown in FIG. 5 so that a position of occurrence of a jam is indicated by emitting light from a first light emitting element 12*a* when a first sensor 10*a* detects a jam and from a second light emitting element 12*b* when a second sensor 10*b* detects a jam. The operator thus easily knows the area to be opened among the two opening areas. This enables more rapid dealing with a jam than that in the above-described embodiment.

Figure 4:
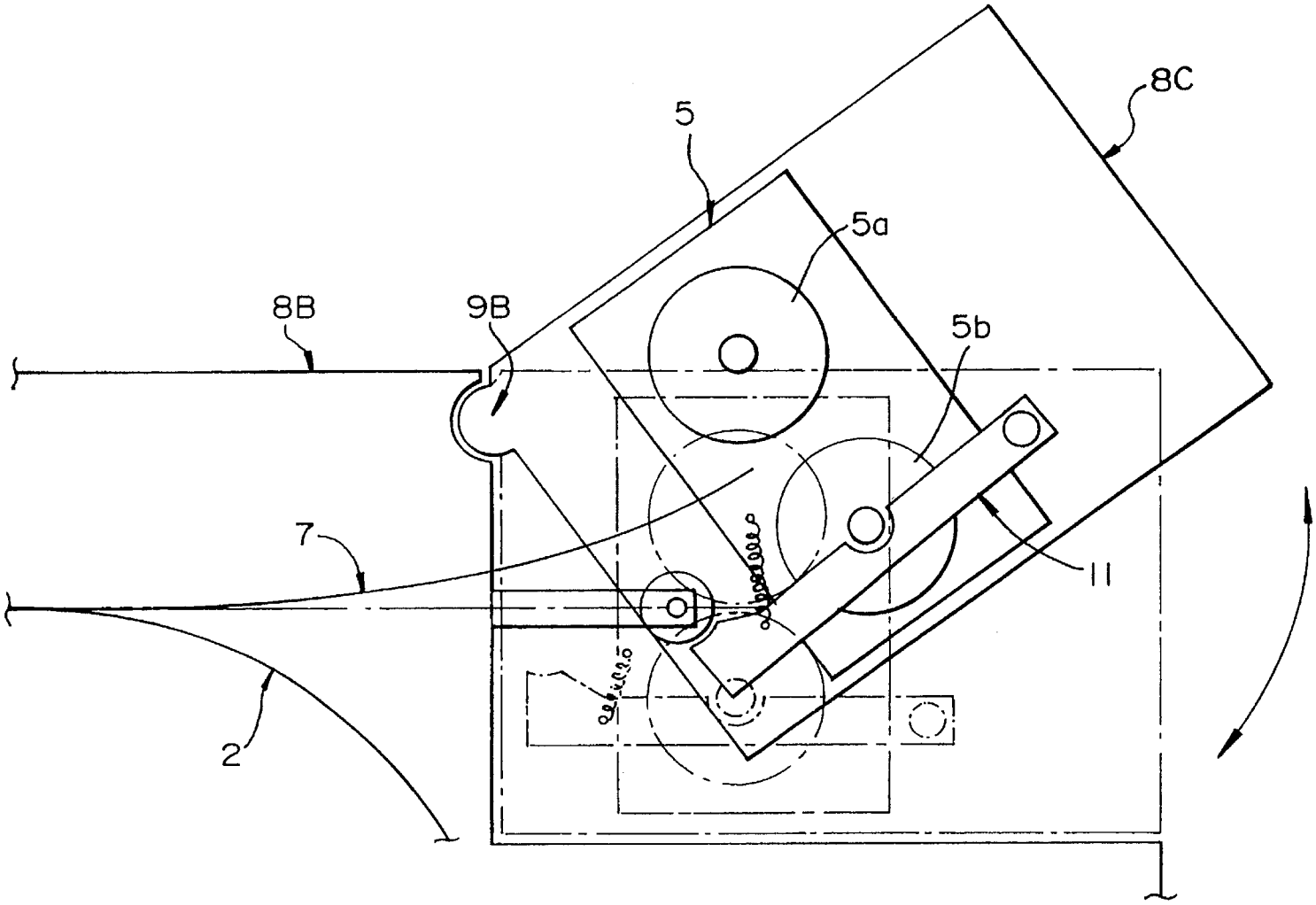
FIG. 4 is a side view of a fixing portion casing provided with a fixing device in accordance with an embodiment of the invention.

FIG. 4 shows another embodiment of the openable portion of the fixing portion casing 8C. In this embodiment, a fixing device pressure release lever 11 for releasing the pressure between the opposite fixing rollers 5*a*, 5*b* in the fixing device 5 is operated in linkage to the operation of opening the fixing portion casing 8C.

Even in the case of a complicated jam in which the leading edge of the transfer material 7 is caught in the fixing device 5, since the pressure between the fixing rollers is released at the same time as the opening of the fixing portion casing 8C, the leading edge of the transfer material 7 held between the fixing rollers can be released from the fixing device 5 and assumes a free state after the opening operation. This makes it unnecessary to perform the operation of releasing the leading edge of the transfer material 7 caught in the fixing device 5 from the rollers of the fixing device 5 and thus permits more simple and rapid dealing with a jam.

Each of the above embodiments is further described in detail below.

Figure 6:
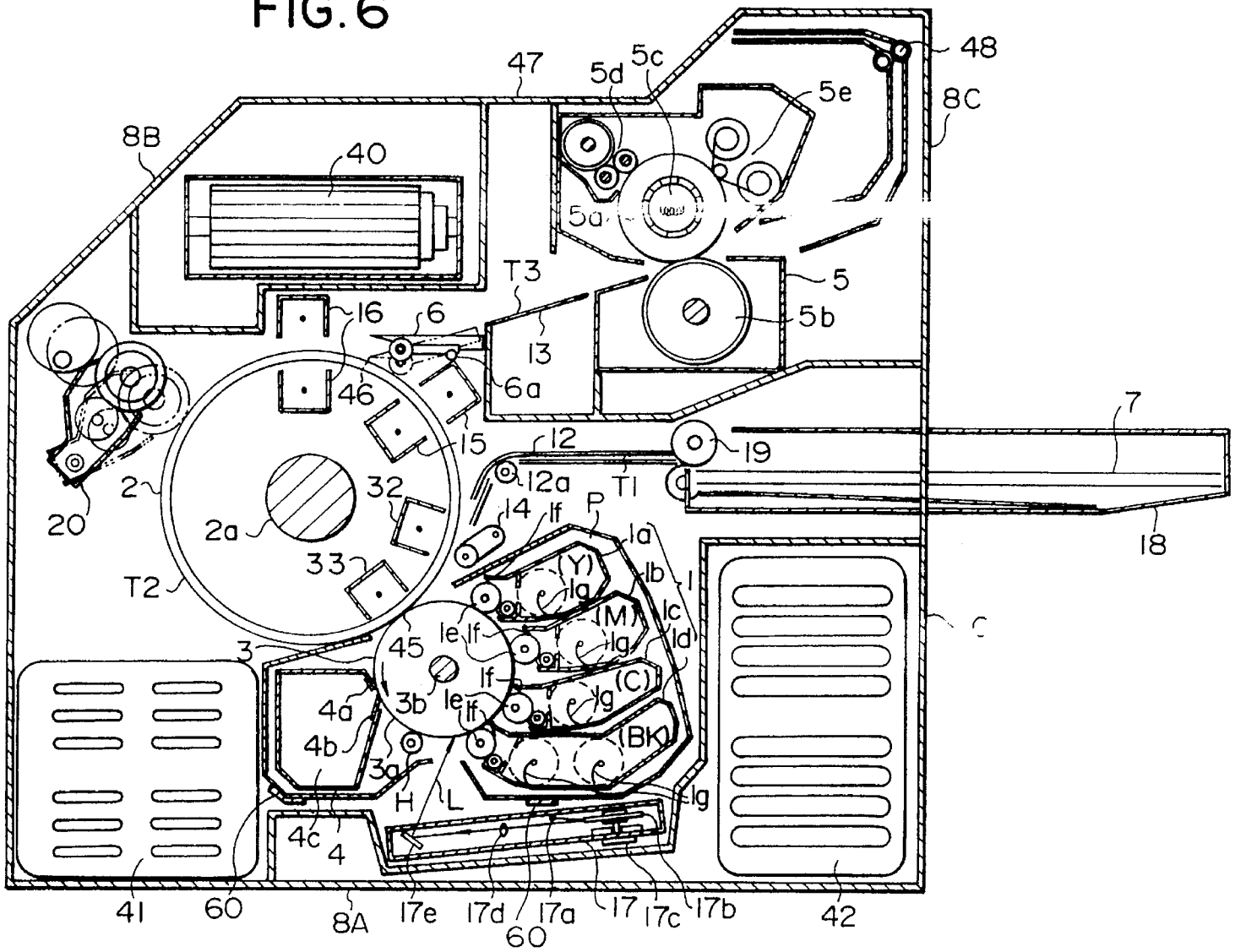
FIG. 6 is a sectional side view of a color image forming apparats in accordance with an embodiment of the present invention.
Figure 7:
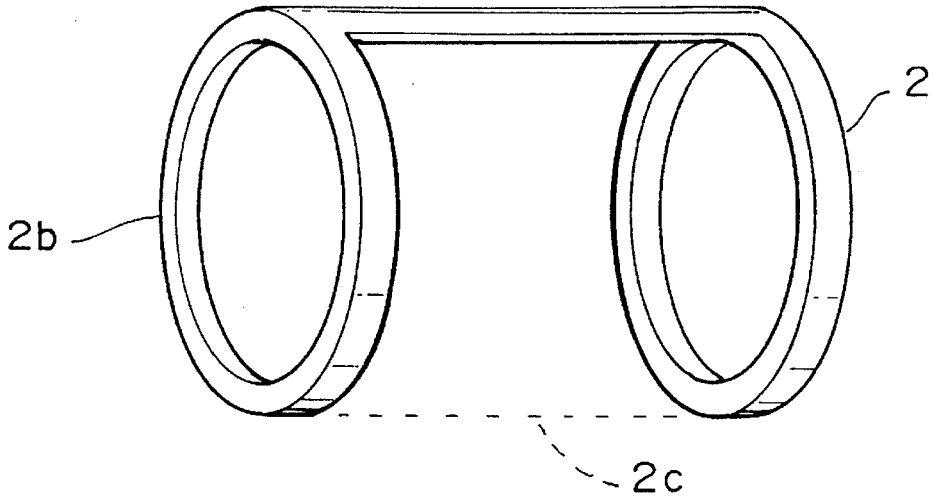
FIGS. 7(A) and 7(B) are perspective views of a transfer drum.
Figure 7:
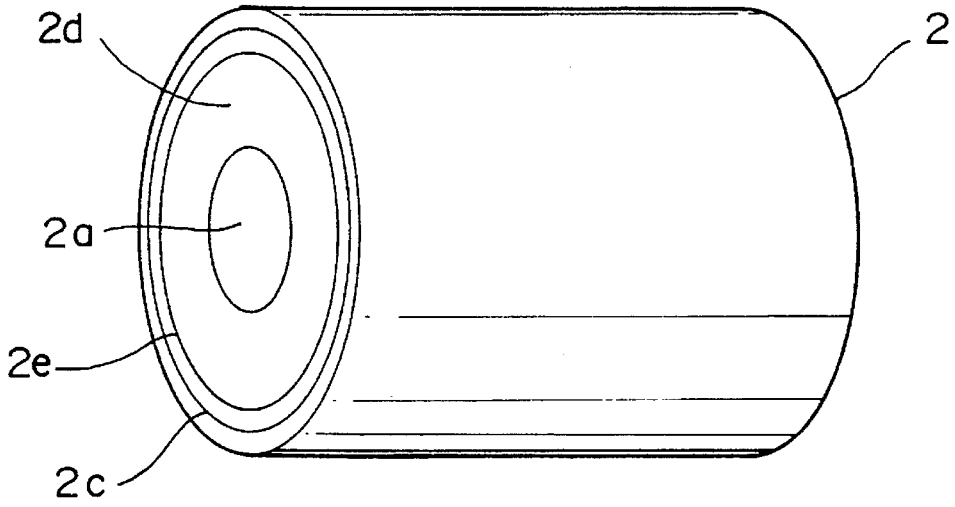

A color laser beam printer C as a color image forming apparatus in accordance with the present invention is described below with reference to FIG. 6. In FIGS. 6 and 7, the division boundaries in the apparatus body are not shown.

The color image forming apparatus C employs a method of forming overlapped images of a plurality of colors on recording paper by repeating several times the process of transferring, on the transfer material such as recording paper or the like, the record image formed on an image supporting member 3 by charging, exposure and development to form a color image. As shown in FIG. 6, the color image forming apparatus of this embodiment comprises development units 1 (1*a*, 1*b*, 1*c*, 1*d*), respectively, containing color developers, a development device for visualizing an electrostatic latent image formed on the image supporting member 3, a transfer member 2 holding the supplied transfer material 7 by electrostatic adsorption or a transfer material holding means such as a gripper, or the like, so as to transfer the image on the image supporting member 3 to the transfer material 7, the image supporting member 3 supporting the electrostatic latent image written by the optical signal L emitted from an exposure device 17 having a light source such as a laser, or the like, and the visible image developed by the development units 1, a cleaner 4 for cleaning off the developer remaining on the image supporting member 3 after the image is transferred to the transfer material 7, and the fixing device 5 for fixing the visual color image transferred to the transfer material 7 thereon.

In this embodiment, the development units 1*a*, 1*b*, 1*c* and 1*d* contain yellow toner (Y), magenta toner (M), cyan toner (C) and black toner (BK), respectively. Each of the development units has a development sleeve 1*e*, a doctor blade 1*f*, an agitation blade 1*g*, and so on. The image supporting member 3 is, for example, a photosensitive drum having an organic photosemiconductor layer 3*a* formed on the periphery thereof, and is rotated counterclockwise about the shaft 3*b*. The cleaner 4 has an elastic cleaning blade 4*a*, a receiving sheet 4*b* and a waste toner tank 4*c*. Further, this embodiment employs a so-called process cartridge system in which the electrophotographic photosensitive drum 3 serving as the image supporting member and the process means, for example, the charge means H, the development means 1 and the cleaner 4, are incorporated in the cartridge which is made detachable from the apparatus body C. However, the embodiment is not limited to this system. In FIG. 6, reference numeral 60 denotes fitting means for detachably fitting the process cartridge P. The fixing device 5 has a heater 5*c* contained in a heating roller 5*a* having oil coating means 5*d* and cleaning means 5*e* provided on the periphery thereof. Reference numeral 40 denotes a fan for generating an air flow in the apparatus body C, and reference numerals 41, 42 respectively denote openings provided in the side of the apparatus body C.

A description will now be made of the exposure device 17. When an image signal is input to a laser diode 17*a* from a host device 202 (FIG. 20), the laser diode 17*a* applies image light corresponding to the image signal to a polygon mirror 17*b*. The polygon mirror 17*b* is rotated at a high speed by a scanner motor 17*c* so that the image supporting member 3 is selectively exposed to the image light reflected from the mirror 17*b* and passed through an imaging lens 17*d*, a reflecting mirror 17*e* and an exposure opening 51 of the process cartridge P.

In addition, as shown in FIG. 7(A), the transfer member 2 comprises a hollow drum casing 2*b* from which the only transfer region in the periphery thereof is cut away and is covered with a flexible sheet 2*c* of a polymer such as polyethylene terephthalate (PET), polyvinylidene fluoride (PVdF), fluorinated ethylene propylene copolymer (FEP), polycarbonate, polyurethane or the like. Further, an adsorption roller 14 serving as means for electrostatically adsorbing the transfer material 7 on the flexible sheet 2*c*, an adsorption charger 32 provided opposite to the adsorption roller 14 so as to charge the flexible sheet 2*c*, a transfer charger 33 for transferring the image formed on the image supporting member 3 to the transfer material 7, a separation charger 16 for separating the transfer material 7 electrostatically adsorbed on the flexible sheet 2*c*, a separation claw 6 for assisting separation of the transfer material 7 and guiding the transfer material 7 to the fixing device 5, and a sheet destaticizing charger 15 for initializing the potential of the flexible sheet 2*c*, all of which are provided inside and outside the transfer member 2 along the direction of rotation thereof. The separation claw 6 can be rotated about a shaft 6*a* and separated from and brought into contact with the peripheral surface of the transfer member 2.

The image forming process of the color image forming apparatus comprising the aforementioned devices is described below. The electrostatic latent image of a first color formed on the image supporting member 3 by exposure light L emitted from the exposure device 17 on the basis of the image signal of the first color output from the host device 202 (refer to FIG. 20) is developed by the development unit 1*a* containing, for example, a yellow (Y) developer to form a visible image. In parallel to this process, the transfer material 7 supplied is held between the adsorption roller 14 and the transfer member 2, and at the same time, charge is applied by the adsorption charger 32 to the transfer material 7 from the rear side of the flexible sheet 2*b* which forms the surface of the transfer member 2 so that the transfer material 7 is electrostatically adsorbed on the surface of the transfer member 2. The transfer material 7 held on the peripheral surface of the transfer member 2 is conveyed by rotation of the transfer member 2 to the image transfer portion 45 placed opposite to the image supporting member 3. The image formed on the image supporting member 3 is transferred to the transfer material 7 by the transfer charger 33 opposed to the image supporting member 3. The developer remaining on the image supporting member 3 is then removed by the cleaner 4, an electrostatic latent image is again formed on the image supporting member 3 by exposure light emitted from the exposure device 17 on the basis of the image signal of a second color output from the host device 202. The electrostatic latent image is developed by the development unit 1*b* containing, for example, a magenta (M) developer corresponding to the image signal of the second color to form a visual image. This visual image of the second color is again transferred by the transfer charger 33 to the transfer material 7 to which the visual image of the first color has already been transferred. Visible images of third and fourth colors are formed on the image supporting member 33 by using the developers of cyan (C) as a third color and of black (BK) as a fourth color, respectively, and are then overlapped on and transferred to the transfer material 7 on the transfer member 2 by the same method as that employed for the visible image of the second color.

The transfer material 7 to which the visible image of each of the colors is transferred is then conveyed by rotation of the transfer member 2 to the opposite separation chargers 16 respectively disposed inside and outside the transfer member 2, and the electrostatic adsorption force between the transfer material 7 and the flexible sheet 2 is removed by the separation chargers 16. The transfer material 7 is thus separated by the separation claw 6 disposed in contact with the peripheral surface of the transfer member 2 in the separation region 46. The separated transfer material 7 is sent to the fixing device 5 in which the visible images are fixed to the transfer material 7. After the transfer material 7 is separated from the transfer member 2, the transfer member 2 is destaticized by the sheet destaticizing charger 15 to be electrically initialized.

The transfer member 2 in a cut-out structure has been described above as a typical example of the transfer member 2 used for imaging a color image by a multiple transfer method. However, the same multiple transfer can also be performed by a method of applying a bias to a transfer member 2 comprising an electrically conductive drum casing 2*d* which is not cut off and which is coated with an elastic member 2*e* made of urethane foam, silicone rubber foam or the like and further coated with a flexible sheet 2*c*, as described above, as shown in FIG. 7(B). This type of transfer member 2 has the advantages that the cost can be decreased due to the simplification of the inside thereof, as compared with the transfer member 2 in a cut-off structure, and that the deformation and breakage of the flexible sheet 2*c*, which are problems of the transfer member 2 in a cut-off structure, can be decreased due to the support of the sheet 2*c* from the inside of the transfer member 2. A color image forming apparatus which uses a drum (referred to as "solid drum" hereinafter) having no cut-off portion thus attracts attention now. The image forming method employed by the color image forming apparatus using the solid drum is extremely similar to that employed in the apparatus using the cut-off drum. The image formation in the color image forming apparatus using the solid drum is described below with reference to FIG. 8.

Figure 16:
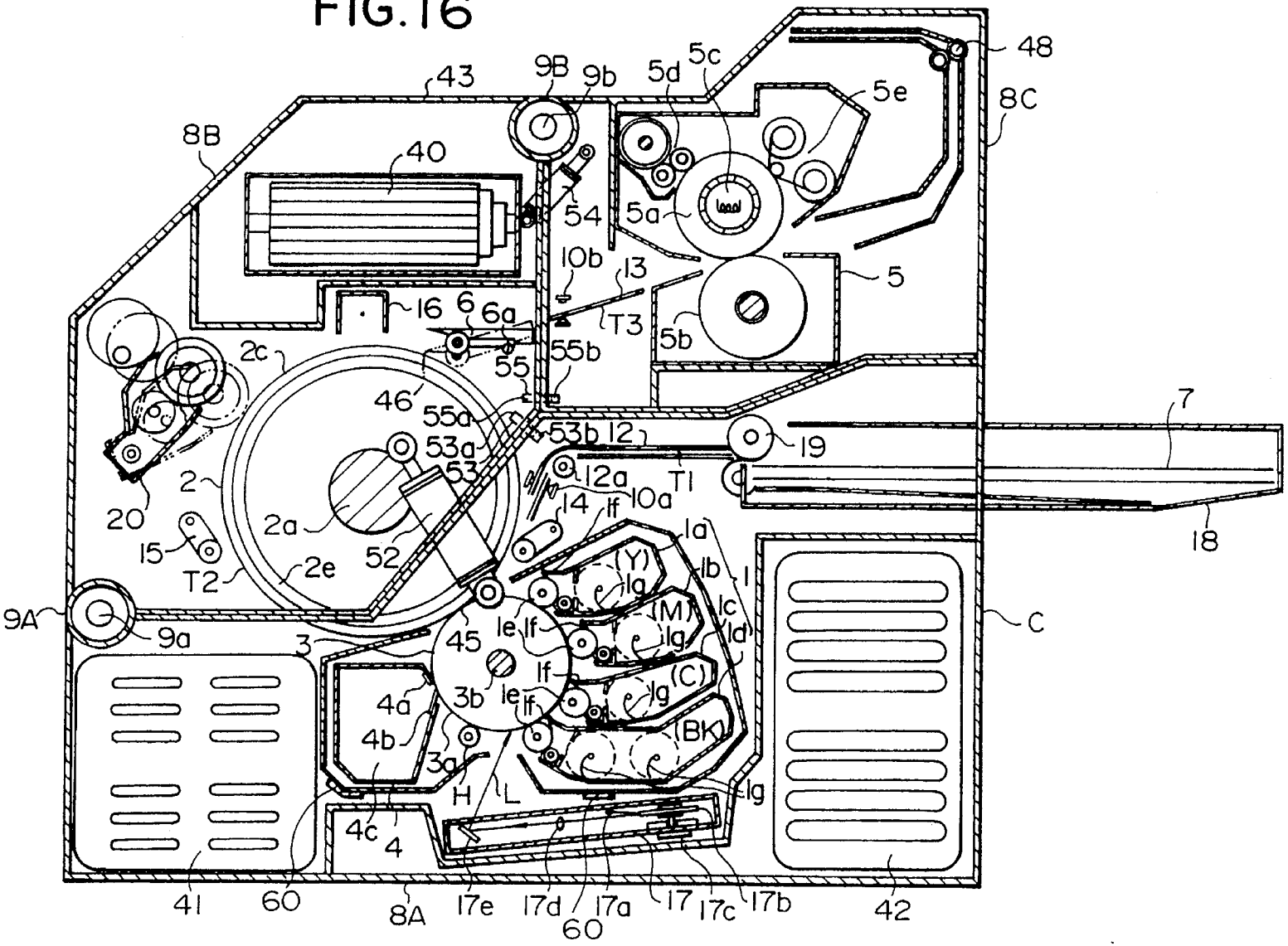
FIG. 16 is a sectional side view of a color image recording apparatus in accordance with an embodiment of the present invention.

The image forming means shown in FIG. 8 having same arrangement and functions as those of the means shown in FIG. 16 are termed the same names and denoted by the same reference numerals and are not described below.

The transfer material 7 supplied by the transfer material conveyance passage 12 is held between the transfer member 2 and the adsorption roller 14 by the adsorption roller 14 which separates from and contacts the transfer member 2. At the same time, an adsorption bias is applied to the drum casing 2*b* and the adsorption roller 14, and the transfer material 7 is held on the transfer member 2 by electrostatic adsorption force resulting from the charge induced by the applied bias. The transfer material 7 held on the transfer member 2 is then conveyed by rotation of the transfer member 2 to the image transfer portion where the transfer member 2 faces the image supporting member 3. In the image transfer portion, a visible image of a first color formed on the image supporting member 3 is transferred by the transfer bias applied to the transfer member 2. When a visible image of a second color is then transferred, the value of the above transfer bias is changed so as to compensate for the potential lowered by the transfer of the visible image of the first color to the transfer material 7 on the transfer member 2. Such compensation is made by the same method as that described above during transfer of each of third and fourth colors, so that the visible images formed on the image supporting members 3 are overlapped on and transferred to the transfer material 7 on the transfer member 2. After the above transfer process is completed, the transfer material 7 is destaticized by the separation charger 16, and the electrostatic adsorption force between the transfer material 7 and the transfer member 2 is thus removed. As a result, the transfer material 7 is separated by the separation claw 6 in the separation region 46. The transfer material 7 to which the visible images are transferred is then conveyed to the fixing device 5 in which the visible images are fixed to form a permanent image. Although the transfer process in the color image forming apparatus using the solid drum is described above, the development process in the color image forming apparatus is the same as that in the color image forming apparatus using the cut-off drum.

The present invention can preferably be applied to each of the above color image forming apparatuses.

Still another embodiment of the present invention is described in detail below.

In this embodiment, in order to simply and securely deal with a jam in the holding portion a or a separation portion b, the apparatus body C is divided into a lower casing 8A, an upper casing 8B and a fixing portion casing 8C. The upper casing 8B and the fixing portion casing 8C can be opened relative to the lower casing 8A by rotating the upper casing 8B and the fixing portion casing 8C about the first hinge 9A and the second hinge 9B having rotational shafts 9*a*, 9*b*, respectively, which intersect the direction of conveyance of the transfer material 7 at right angles. Namely, the upper casing 8B is rotated about the first hinge 9A in the direction of arrow A and opened relative to the lower casing 8A like a crocodile's open jaw, and the fixing portion casing 8C is rotated about the second hinge 9B in the direction of arrow B and opened relative to the upper casing 8B. The first hinge 9A is extended from the upper surface of the lower casing 8A to the lower surface of the upper casing 8B. The second hinge 9B is extended from the right side of the upper casing 8B to the left side of the fixing portion casing 8C in the upper portion of the casings.

That is to say, in this embodiment, the apparatus body C is divided into the three portions, i.e., the lower casing 8A, the upper casing 8B and the fixing portion casting 8C so that the three portions can be opened. The passage of conveyance of the transfer material 7 starting from the means (paper feeding cassette 18) for storing the transfer material 7 to the discharge portion 43 receiving the transfer material 7 discharged from the apparatus body C after image formation is shared between the three portions. In addition, the upper casing 8B can be rotated counterclockwise (in the direction of arrow A) so as to be opened relative to the lower casing 8A, and the fixing portion casing 8C can be rotated counterclockwise (in the direction of arrow B) so as to be opened relative to the upper casing 8B.

In this embodiment, the lower casing 8A has the conveyance passage T1 ranging from the feed cassette 18 serving as means for storing the transfer material 7 to the image transfer region 45, the fitting portion for the process cartridge P and the exposure means 17. The upper casing 8B has the conveyance passage T2 ranging from the image transfer region 45 to the separation region 46, the transfer member 2, the separation charger and the separation claw 6. The fixing portion casing 8C has the conveyance passage T3 ranging from the separation region 46 to the discharge portion 43 (the upper surface covering the upper casing 8B and the fixing portion casing 8C) through the fixing device 5 and the discharge rollers 48.

Figure 8:
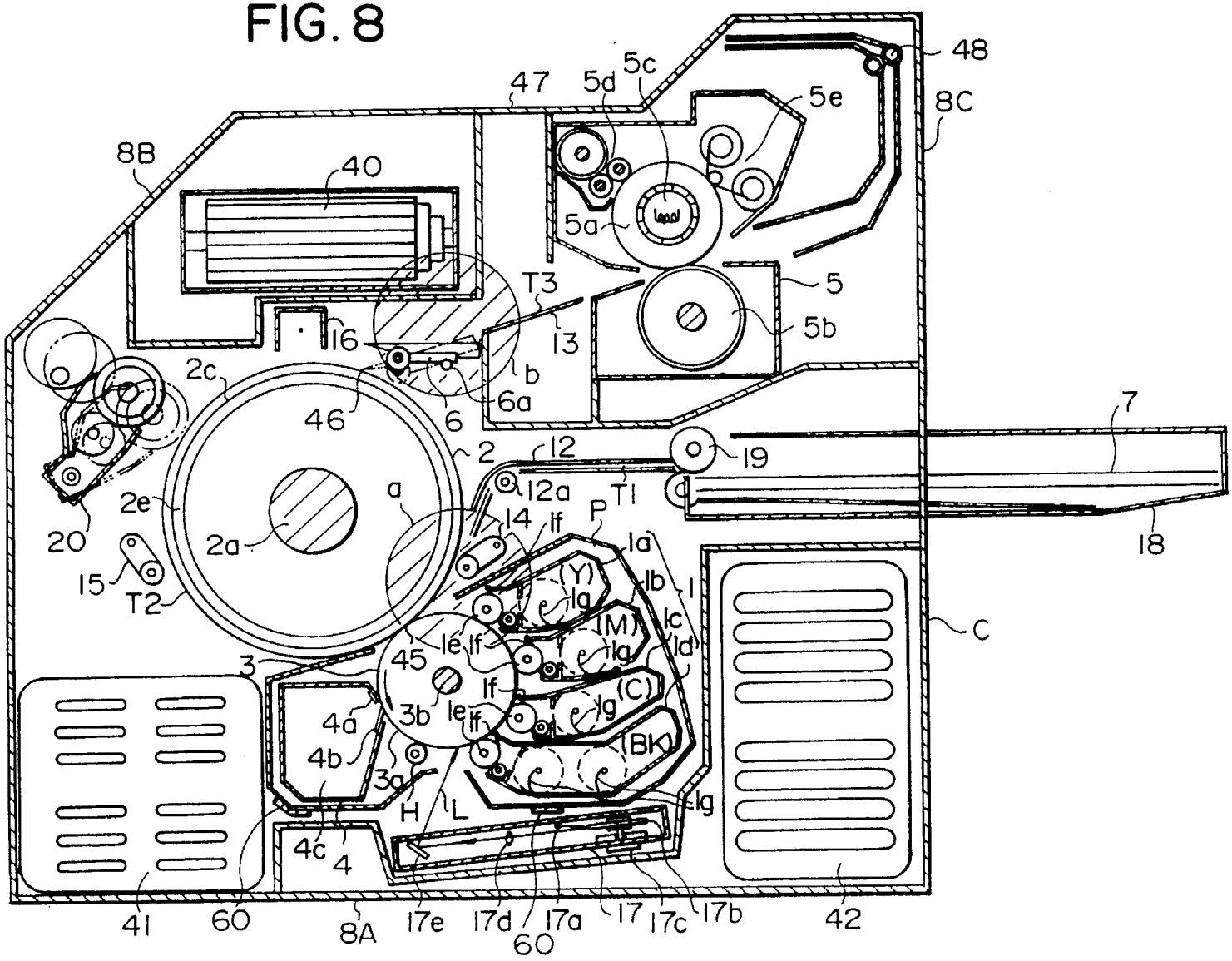
FIG. 8 is a sectional side view of a color image recording apparatus in accordance with an embodiment of the present invention.
Figure 9:
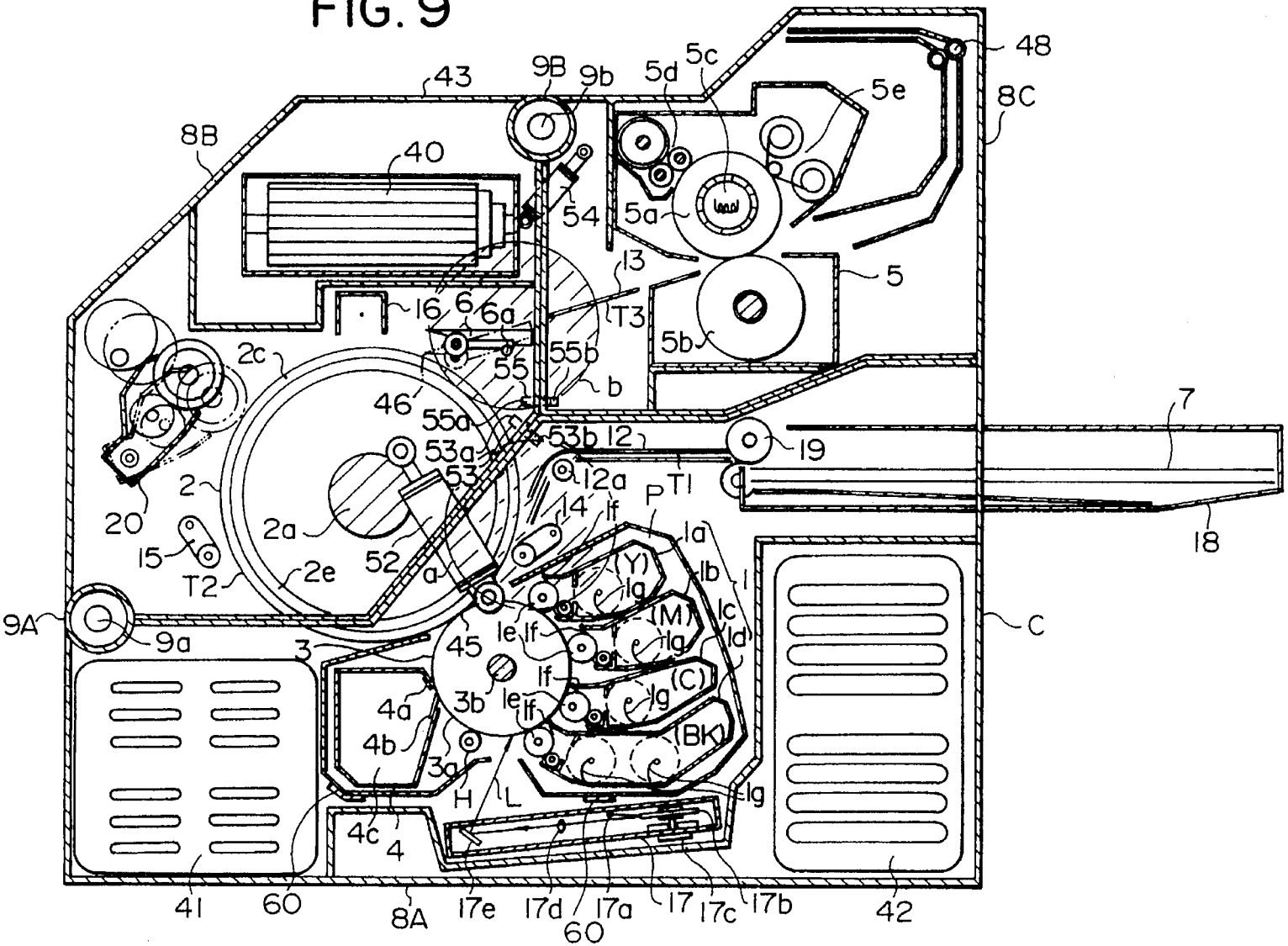
FIG. 9 is a sectional side view of a color image recording apparatus in accordance with an embodiment of the present invention.
Figure 10:
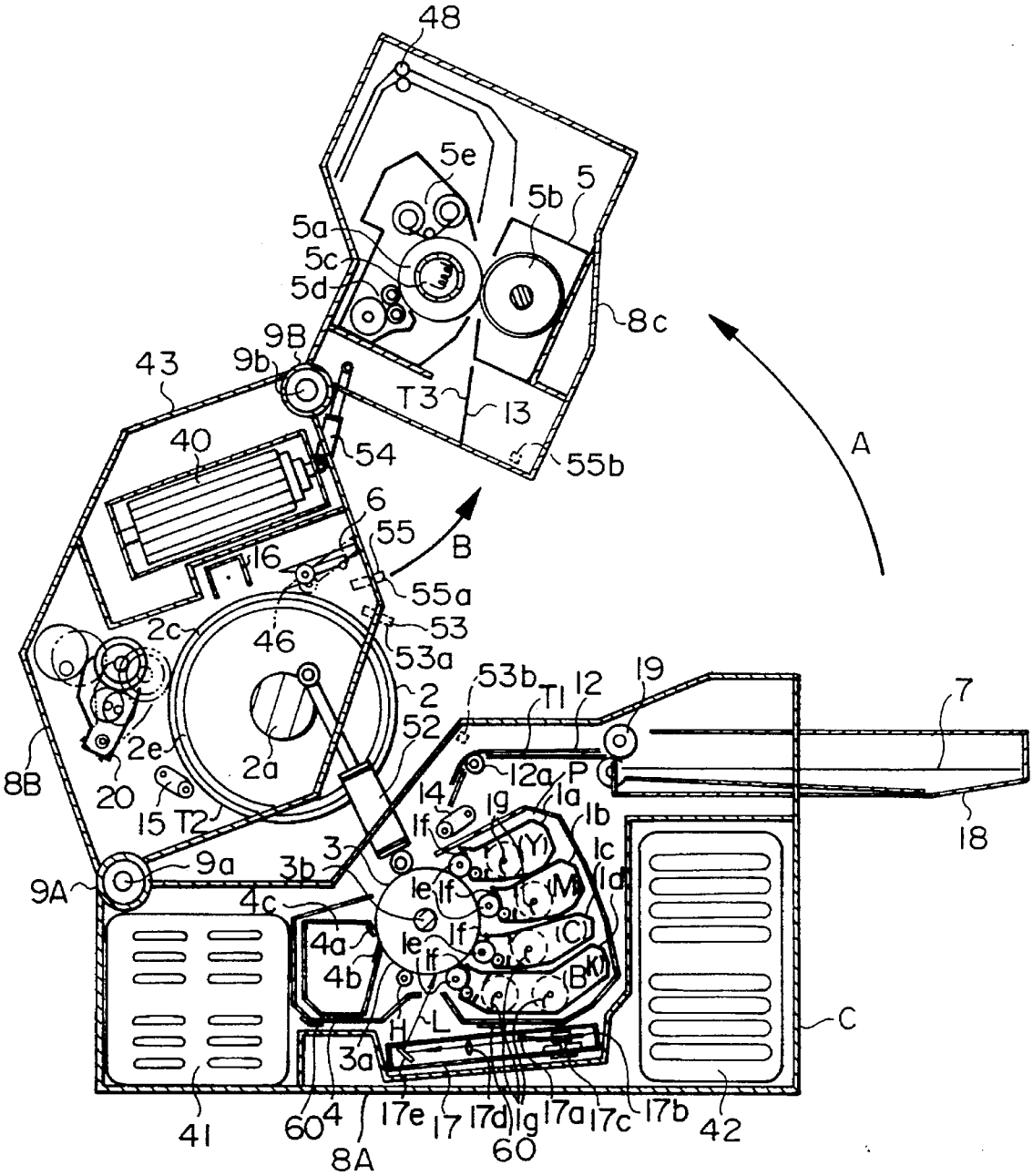
FIG. 10 is a sectional side view of a color image recording apparatus in accordance with an embodiment of the present invention.

In this embodiment, the lower casing 8A and the upper casing 8B and/or the upper casing 8B and the fixing portion casing 8C are opened so that a jam produced in each of the passages, i.e., a jam produced in the holding portion a, the separation portion b, both of which are shown as shadowed portions in FIG. 8, or the like, can easily be dealt with.

In the drawings, reference numeral 52 denotes a torsion spring permitting the operator to slowly upwardly push the upper casing 8B relative to the lower casing 8A by releasing a lock 53 provided on a side wall of the upper casing 8B and maintain an open state. Reference numeral 54 denotes a torsion spring permitting the operator to slowly upwardly push the fixing portion casing 8C against the upper casing 8B by releasing a lock 55 provided on a side wall of the fixing portion casing 8C and maintain an open state. When each of the casings is closed, the operator downwardly pushes the casing against the spring force of the spring 52 or 54 and locks the casing. Namely, the end of the lock lever 53*a* or 55*a* may be engaged with a lock portion 53*b* or 55*b*.

Further, in this embodiment, when either the upper casing 8B or the fixing portion casing 8C is rotated about the first hinge 9A or the second hinge 9B and is opened relative to the lower casing 8A, the driving of the transfer member 2 is cut off in linkage to the opening operation. Mechanisms of cutting of the driving include a mechanism in which the driving gear of the transfer member 2 is separated from the gear on the side of the driving portion such as a motor or the like, and a mechanism in which a switch turned on and off in linkage to the opening operation is provided, and the electromagnetic clutch provided between the transfer member 2 and the driving portion is turned on and off in accordance with the on and off states of the switch.

Figure 11:
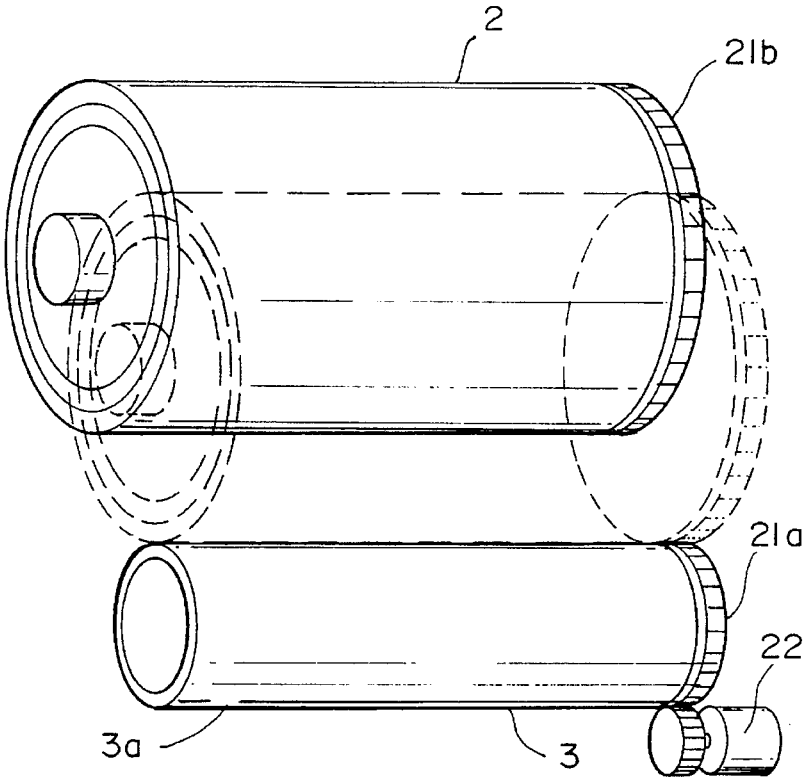
FIG. 11 is a perspective view of a mechanism for transmitting driving force to a transfer drum.

FIG. 11 shows an example of the mechanism for releasing the transmission of driving to the transfer member 2 by separating the driving gear of the transfer member 2 from the gear on the side of the driving portion such as a motor or the like upon opening of the apparatus body. In the drawing, the force of driving the transfer member 2 is transmitted, by a driving motor 22, to the transfer member driving gear 21*b* disposed on the side of the transfer member 2 through the image supporting member driving gear 21*a* disposed on the side of the image supporting member 3. When the lower casing 8A and the upper casing 8B are opened like a crocodile's open jaw by rotating the upper casing 8B about the first hinge 9A so that the transfer member 2 is separated from the image supporting member 3 (when the transfer member 2 is moved from the position shown by dotted lines to the position shown by solid lines in the drawing), the driving of the transfer member 2 is automatically released.

Figure 12:
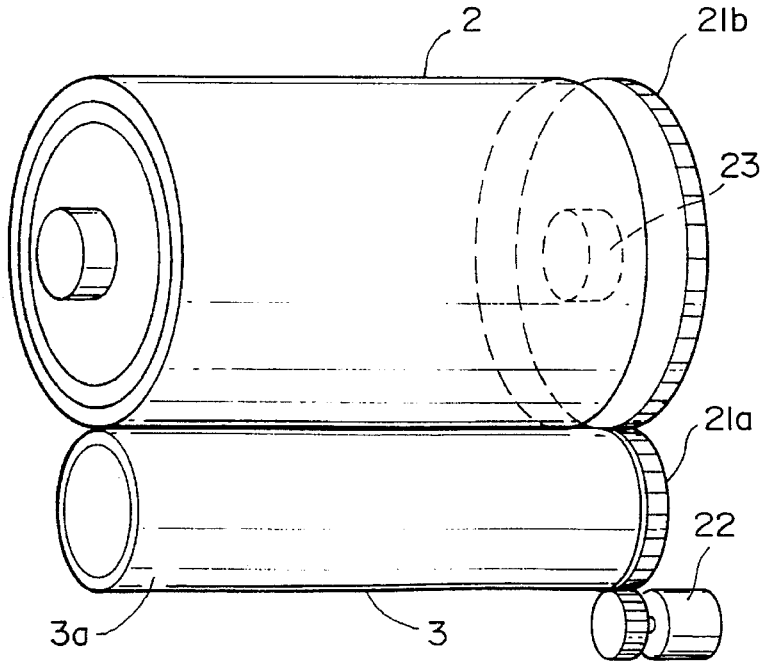
FIG. 12 is a perspective view of another embodiment of the transmitting mechanism shown in FIG. 11.

FIG. 12 shows an example of the mechanism which uses an electromagnetic clutch. The driving force is transmitted to the transfer member 2 from the driving motor 22 through the image supporting member driving gear 21*a*, as shown in FIG. 11. However, the mechanism shown in FIG. 12 differs from that shown in FIG. 11 in the point that the transfer member driving gear 21*b* is connected to the transfer member 2 through an electromagnetic clutch 23. When the electromagnetic clutch 23 is turned off, the transfer member 2 can thus be freely rotated. Although, with the use of the electromagnetic clutch 23, the electromagnetic clutch 23 must be turned on and off in linkage to the opening and closing of the upper casing 8B and the fixing portion casing 8C relative to the lower casing 8A, a door switch 49 for detecting opening and closing may be disposed on the portion of the lower casing 8A which contacts each of the upper casing 8A and the fixing portion casing 8C so that the electromagnetic switch 23 is turned on and off in accordance with the on and off states of the door switch 49. If the electromagnetic switch 23 used cuts off the connection in the off state of the power source, a mechanism for cutting the power source during dealing with a jam, which is generally frequently used as a safety measure, can be used as it was, and the door switch 49 need not be provided.

Figure 13:
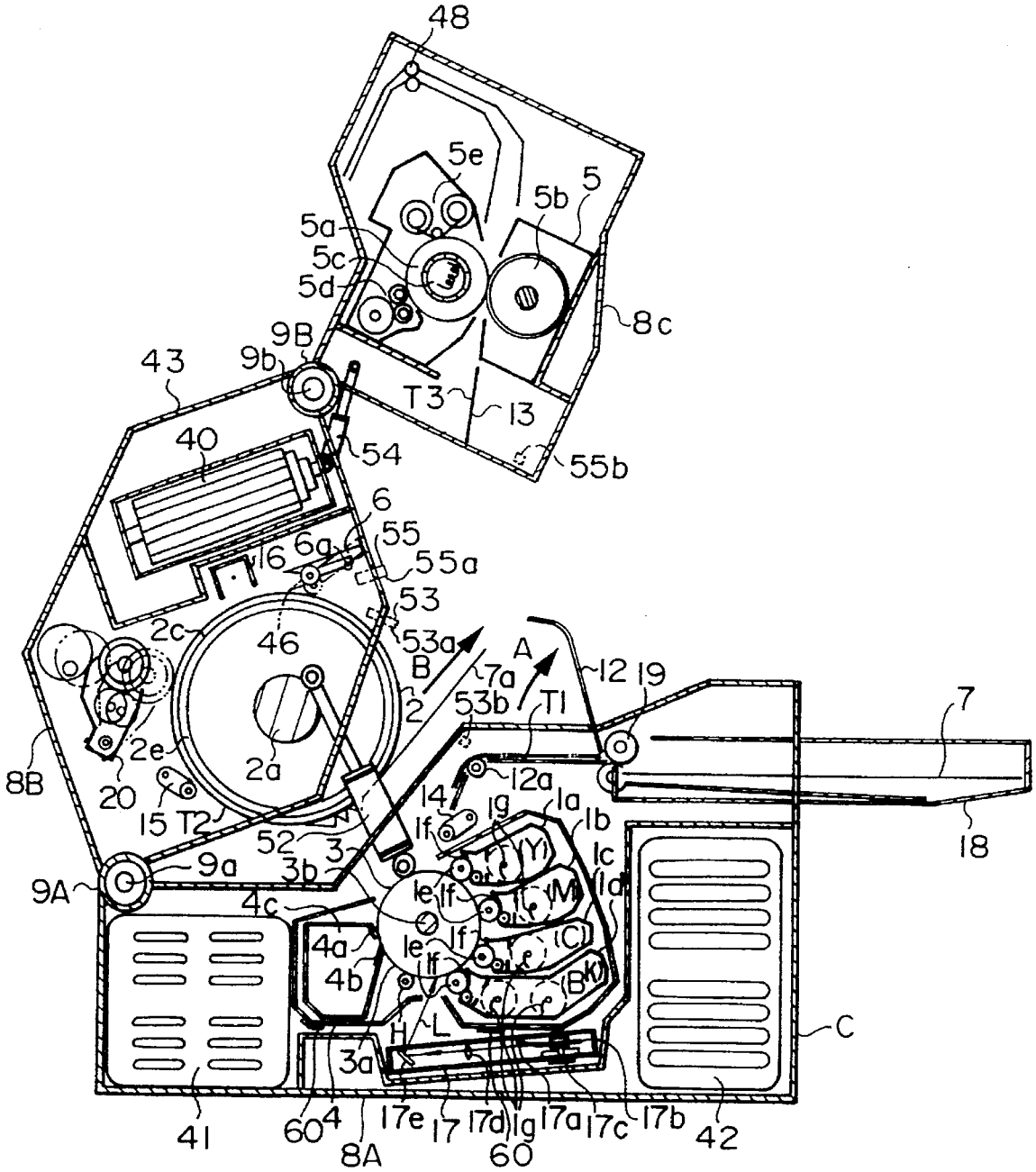
FIG. 13 is a sectional side view of a color image recording apparatus in accordance with an embodiment of the present invention.

The aforementioned mechanism brings the transfer member 2 into the state where it can freely be rotated about the rotational shaft 2*a* during dealing with a jam. For instance, when the transfer material 7 is jammed in the holding portion a, the upper casing 8B is opened relative to the lower casing 8A like a crocodile's open jaw by rotating the upper casing 8B about the first hinge 9A, as shown in FIG. 13. If the transfer material 7 is partially present on the conveyance passage 12 thereof, the conveyance passage 12 is then opened in the direction of arrow A by rotating clockwise a guide 12*a* on the passage 12, and the trailing end of the transfer material 7*a* is pulled out in the direction of arrow B, i.e., in the direction which allows the rotation of the transfer member.

Figure 14:
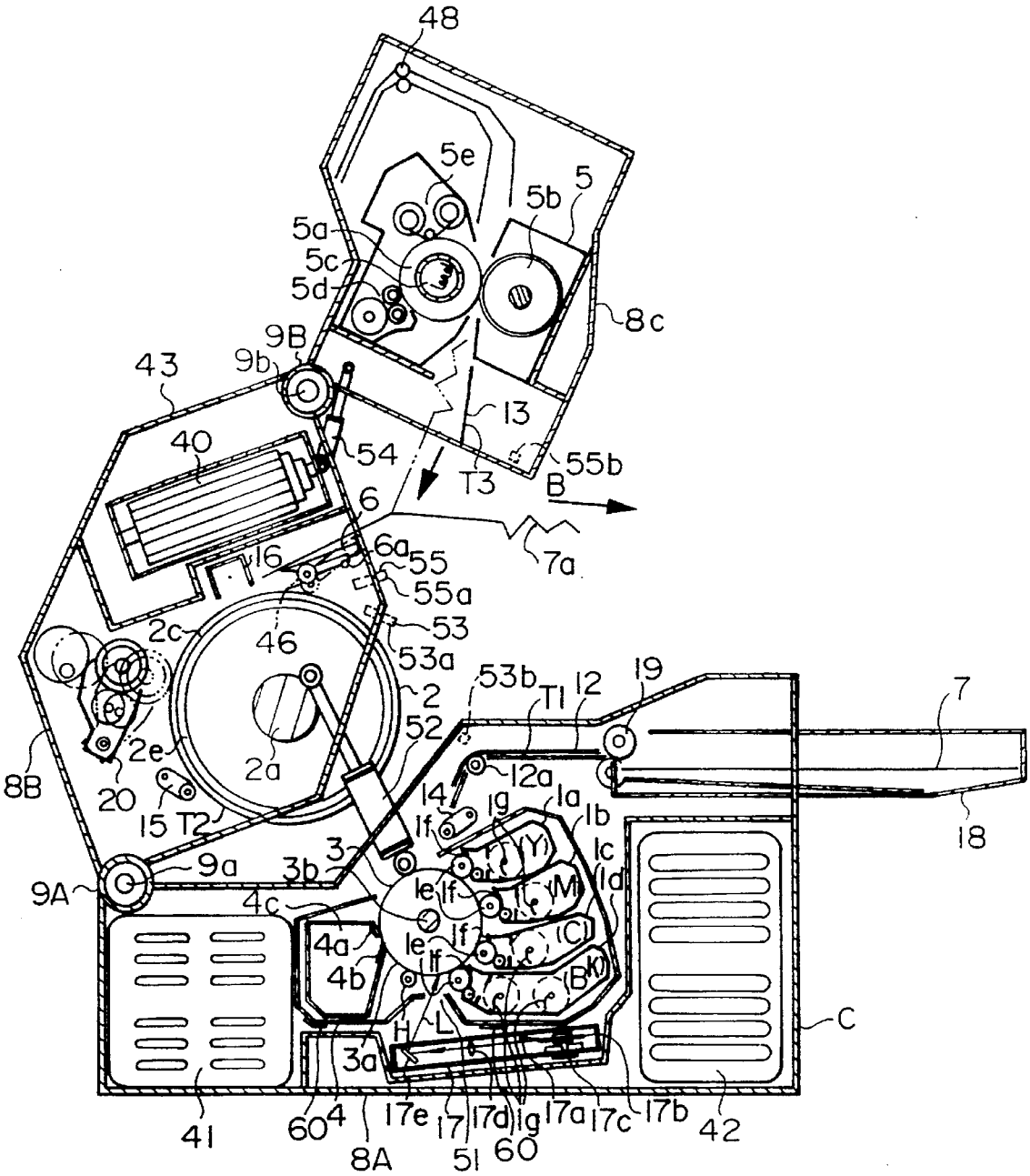
FIG. 14 is a sectional side view of a color image recording apparatus in accordance with an embodiment of the present invention.

When a jam occurs in the separation portion b, the upper casing 8B is opened relative to the lower casing 8A like a crocodile's open jaw by rotating the upper casing 8B about the first hinge 9A, and further, the fixing portion casing is opened relative to the upper casing 8B by rotating the fixing portion casing 8C about the second hinge 9B, as shown in FIG. 14. An end of the transfer material 7 is then pulled in the direction of arrow B, as in the above-described dealing with a jam. In this case, the transfer material 7*a* jammed can be separated from the transfer member 2 by pulling out the material 7*a* together with the rotation of the transfer member 2 because the driving of the transfer member 2 is cut off. As a matter of course, when the driving of the transfer member 2 is released by the electromagnetic clutch 23, the jam produced in the separation portion b may be dealt with by opening the fixing portion casing 8C only relative to the lower casing 8A like a crocodile's open jaw because the driving of the transfer member 2 is released by opening the fixing portion casing 8C only relative to the lower casing 8A like a crocodile's open jaw.

This embodiment thus permits a jam to be dealt with by simply pulling an end of the transfer material 7 in the direction of arrow B shown in FIGS. 13 and 14, i.e., in the peripheral direction of the transfer member 2, even if the transfer material 7 remains held by the transfer member 2 by electrostatic adsorption or holding means such as a gripper or the like.

Figure 15:
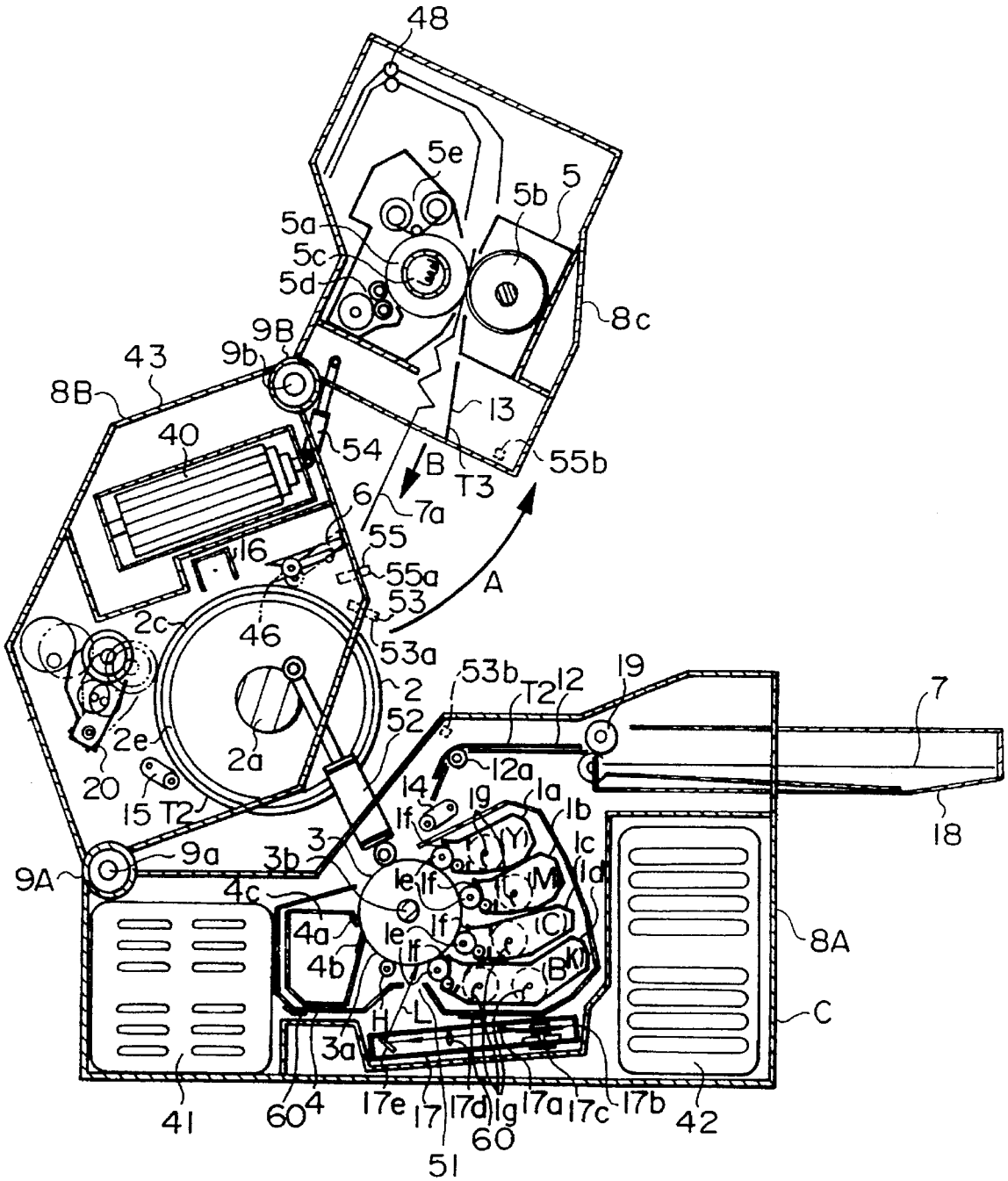
FIG. 15 is a sectional side view of a color image recording apparatus in accordance with an embodiment of the present invention.

In addition, when the fixing device 5 comprises a pair of fixing rollers which are opposed at predetermined pressure, in some cases, the transfer material 7 jammed in the separation portion b is partially caught in the fixing device 5. In this case, the upper casing 8B is opened relative to the lower casing 8A like a crocodile's open jaw for releasing the driving of the transfer member 2, and the fixing portion casing 8C is then opened relative to the upper casing 8B like a crocodile's open jaw. As a result, as shown in FIG. 15, the trailing end of the transfer material 7*a* is automatically released from the transfer member 2 in accordance with the operation of opening the fixing portion casing 8C and the upper casing 8B, while the leading end thereof being caught in the fixing device 5. The rollers of the fixing device 5 are rotated in the reverse direction or the pressure between the rollers is released after the fixing portion casing 8C and the upper casing are opened, and the leading end of the transfer material 7 is then pulled out of the fixing device 5, whereby the jam produced in the separation portion b can be dealt with.

Although this embodiment employs as an example the mechanism of releasing the driving of the transfer member 2 shown in FIG. 11 or 12, any mechanism which permits the driving of the transfer member 2 to be released in linkage to the opening of the upper casing 8B or the fixing portion casing 8C during dealing with a jam can be used, and other methods may be of course appropriately be used. Further, although this embodiment uses the transfer member 2 comprising a solid drum, the transfer member 2 comprising a cut-out drum may be of course used in this embodiment. Further, although it is preferable that the driving of the transfer member 2 is released in linkage to the opening of the apparatus body, the driving need not be released, and this embodiment exhibits sufficient effects only by opening the apparatus body, as described above.

FIG. 16 shows a still further embodiment of the present invention.

In this embodiment, a first sensor 10*a* and a second sensor 10*b* are disposed at a downstream position and an upstream position on transfer material conveyance passages 12 and 13, respectively, in a transfer member 2 so as to detect the state of conveyance of the transfer material 7.

Figure 17:
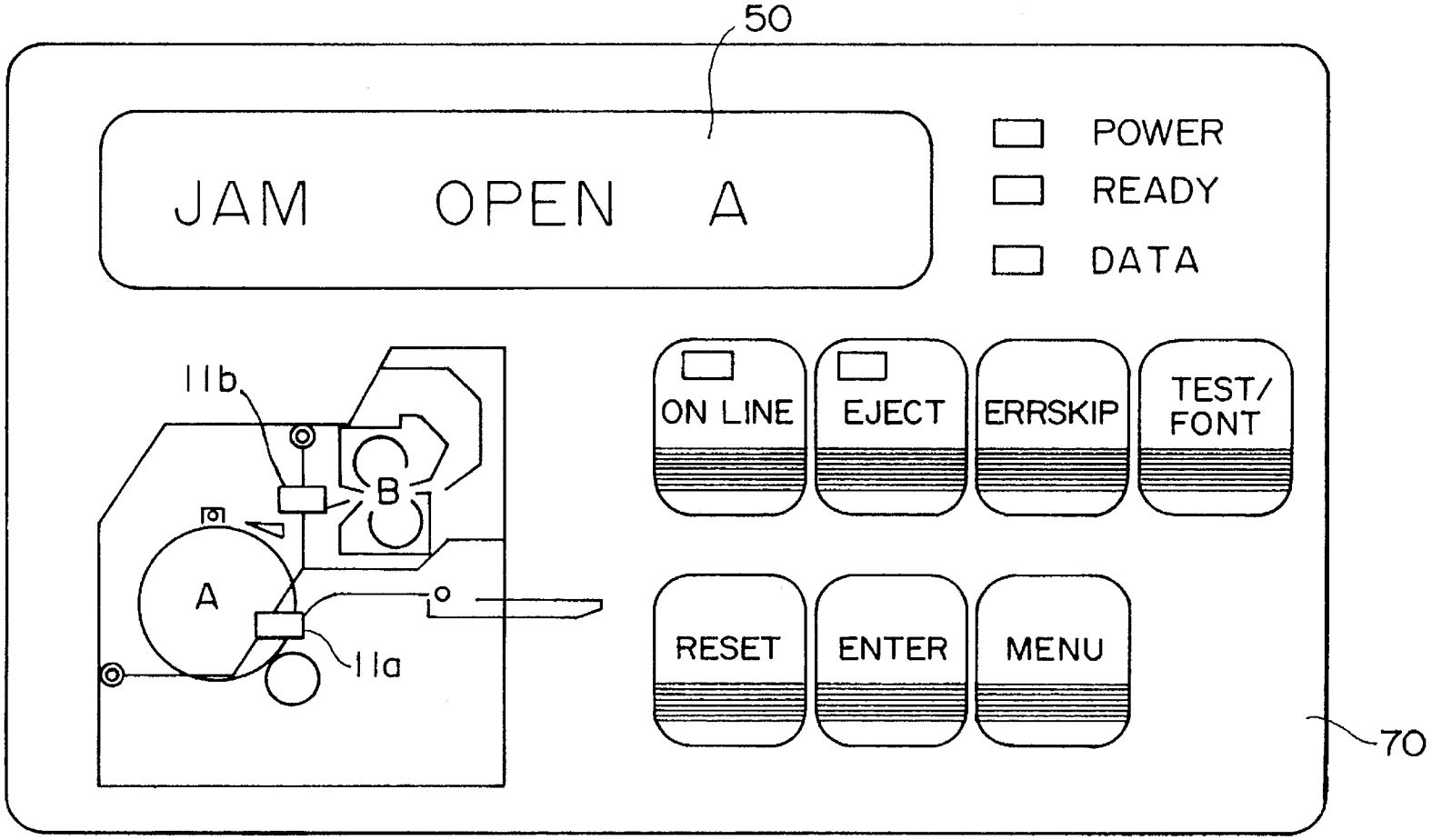
FIG. 17 is a plan view of a display panel.

These sensors 10*a*, 10*b* detect the presence of the transfer material 7 on the transfer material conveyance passages 12, 13, respectively. An optical sensor comprising combination of a light-emitting element such as a light-emitting diode or the like and a light-receiving element such as a phototransistor or a mechanical sensor such as a microswitch is used as the sensors 10*a*, 10*b*. For example, if this embodiment is configured so that a signal is output only when the transfer material 7 is present on the transfer material conveyance passage, the time a sensor outputs a signal during normal conveyance is the time taken from the passage of the leading end of the transfer material 7 through a certain point in the apparatus to the passage of the trailing end therethrough when the transfer material conveyed is longest among the transfer materials handled by the apparatus. If a signal is output for a time longer than this time, it is thus decided that the transfer material 7 is jammed on the transfer material conveyance passage 12 or 13. For example, the display panel 70 shown in FIG. 17 is provided on the apparatus, and light is emitted from a first light-emitting element 11*a* when the first sensor 10*a* detects a jam and from a second light-emitting element 11*b* when the second sensor 10*b* detects a jam so as to inform the operation of the position of occurrence of a jam. The combination with such an embodiment enables the operator to immediately decide a portion to be opened among plural portions and thus enables dealing with a jam at a higher speed than that in the above embodiments. In addition, in this embodiment, not only light is emitted from the light-emitting elements but also a message is displayed on a display portion 50. In FIG. 17, the message "JAM OPEN A" is displayed which informs the operator of the jam produced in the portion of the first light-emitting element.

Figure 18:
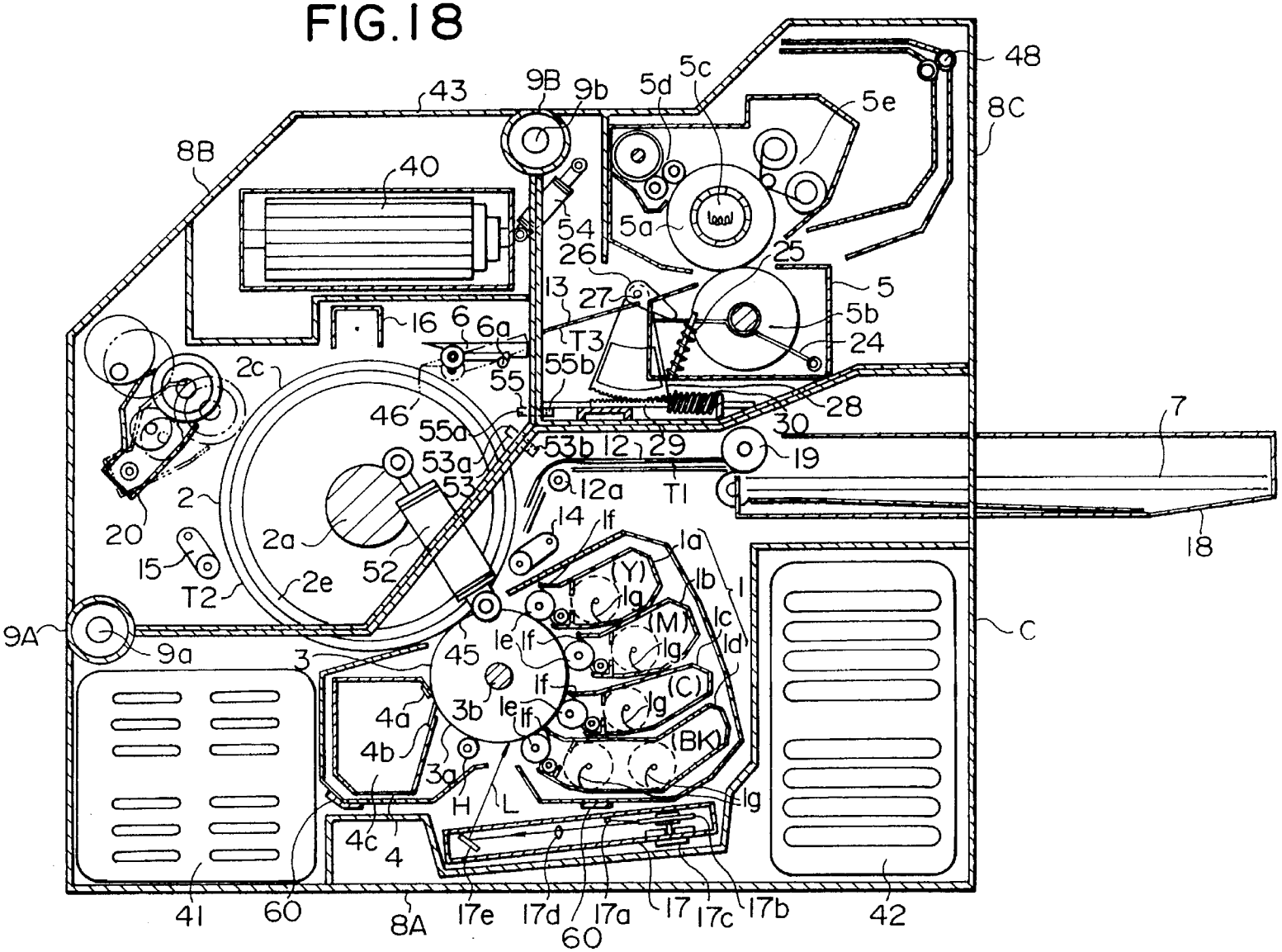
FIG. 18 is a sectional side view of a color image recording apparatus in accordance with an embodiment of the present invention.

FIG. 18 shows a further embodiment of the present invention.

In this embodiment, a fixing device release mechanism for releasing the pressure between the opposite fixing rollers in a fixing device 5 is operated in linkage with the operation of opening the fixing portion casing 8C.

The fixing device 5 using the fixing device release mechanism is the same as the above fixing device 5 except that it is provided with a roller supporting arm 24 which supports the shaft of one of the fixing rollers and which can be rotated about a fulcrum, and a pressure spring 25 which restricts the movement of the roller supporting arm 24 and which presses the fixing roller through the roller supporting arm 24. Further, one end of the roller supporting arm 24 is restricted by an eccentric cam, a gear 28 being disposed on the rotational shaft 27 of the eccentric cam 26 so as to be rotated about the shaft 27. The rotation of the gear 28 is restricted by a rack gear 29 which is provided, by a pressure spring 30 of the rack gear 29, with the tendency to move in the direction opposite to the direction toward the pressure spring 30. Further, a pressure pin 31 which is pressed by the upper casing 8B when the upper casing 8B and the fixing portion casing 8C are opened or closed is placed in the direction in which the rack gear 29 tends to move so that the pressure of the pressure roller **5*b* of the fixing device 5 is finally released by movement of the pressure pin 31**.

Figure 19:
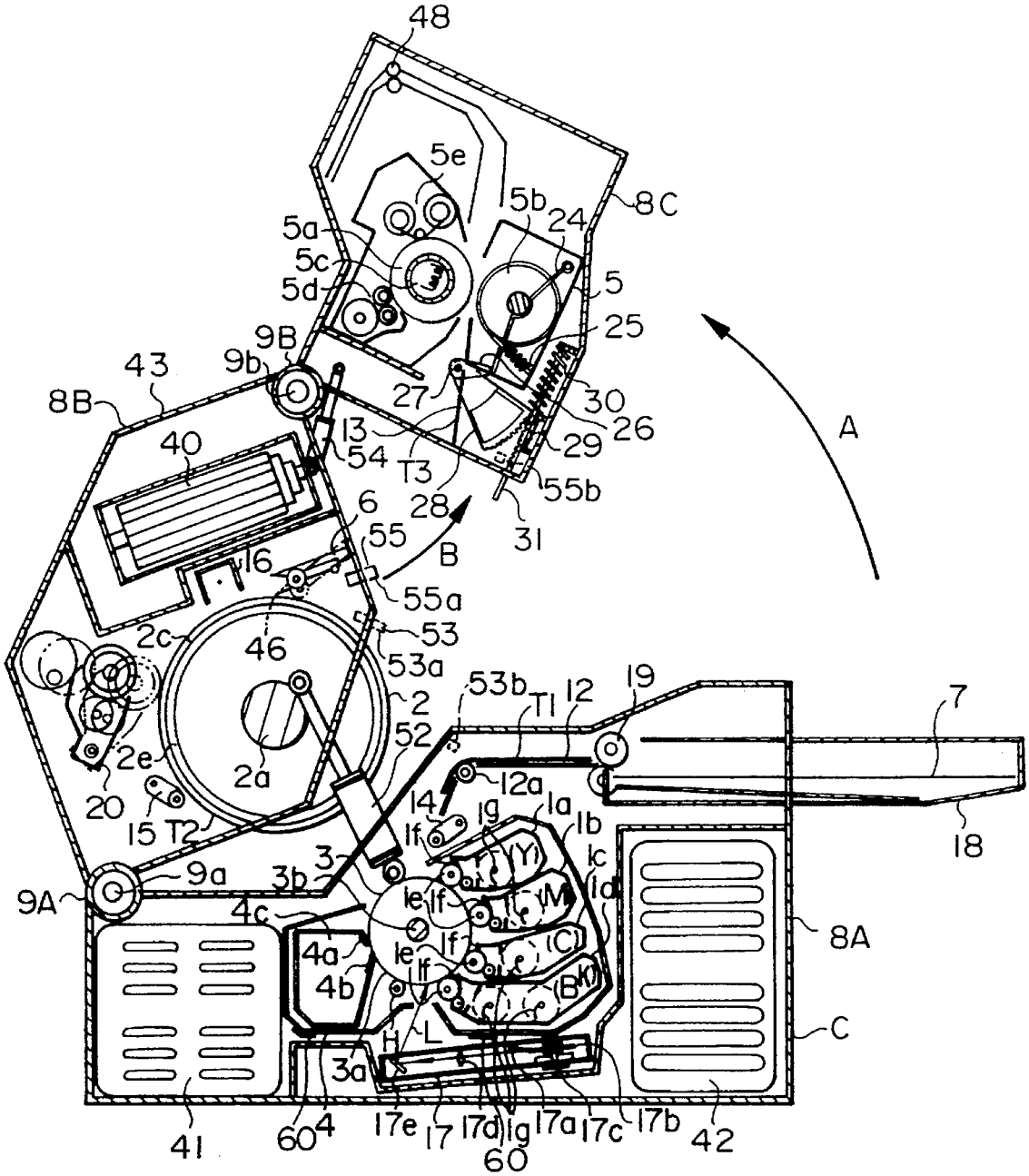
FIG. 19 is a sectional side view of a color image recording apparatus in accordance with an embodiment of the present invention.

Even in the case of a complicated jam in which the leading end of the transfer material 7 is caught in the fixing device 5, since the pressure between the fixing rollers **5*a*, 5*b* is released at the same time as the opening of the fixing portion casing 8C, as shown in FIG. 19, the leading end held between the fixing rollers is released from the fixing device 5 and assumes a free state after the opening operation. The operation of releasing the leading end of the transfer material 7 caught in the fixing device 5** from between the fixing rollers is thus unnecessary, thereby enabling more simple and rapid dealing with a jam.

Figure 20:
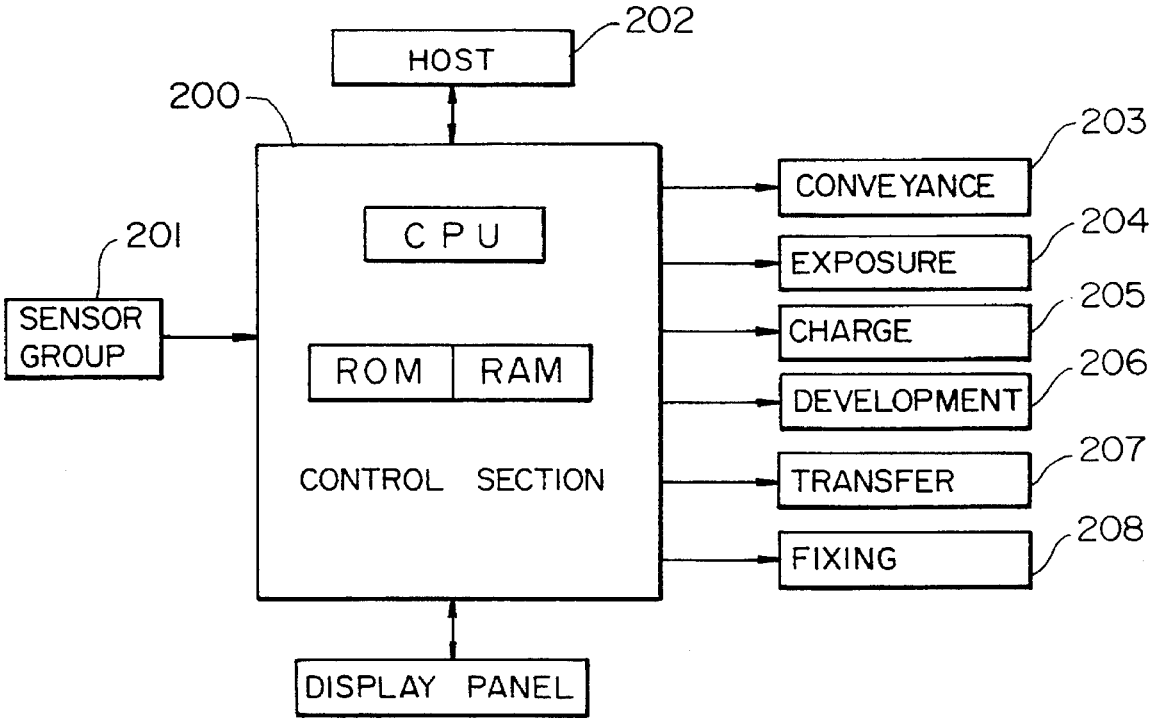
FIG. 20 is a schematic block diagram showing the function of each of the embodiments.
Figure 21:
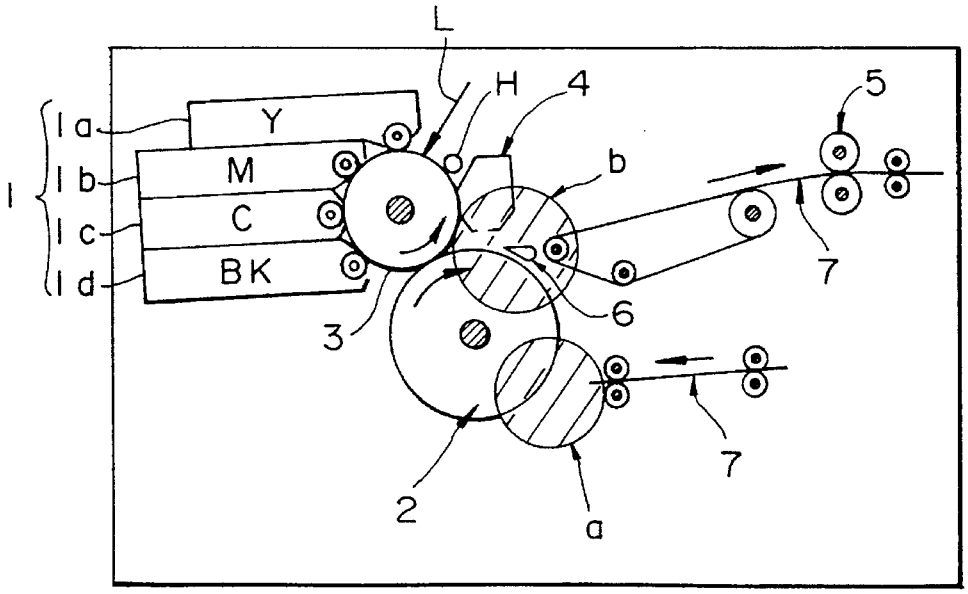
FIG. 21 PRIOR ART
FIG. 21 is a sectional side view of a conventional apparatus.

A description is now be made of the functions of each of the embodiments with reference to the schematic block diagram shown in FIG. 20.

In FIG. 20, reference numeral 200 denotes a control section for controlling the whole apparatus, the control section comprising a CPU such as a microprocessor or the like, a ROM for storing a CPU control program and various items of data, a RAM used as a work area for the CPU and temporarily storing various items of data and so on.

The control section 200 receives a signal from, for example, the door switch 49 or a sensor group comprising the first sensor **10*a* and the second sensor 10*b*. On the other hand, the control section 200 receives image information or the like from a host 202 such as a computer, a word processor or the like. The control section 200 controls each of the processes for conveyance of recording paper 203, exposure 204, charging 205, development 206, transfer 207, fixing 208 and the like on the basis of the information received. The control section 200 also outputs predetermined information to the display panel 70 shown in FIG. 17 and receives predetermined information input from the keys on the display panel 70**.

As described above, the image forming apparatus in accordance with an embodiment of the present invention has a structure in which the transfer material holding portion and separation portion adjacent to the transfer device, in which a jam of the transfer material frequently occurs, can be respectively opened with shafts at centers perpendicular to the direction of conveyance of the transfer material. The image forming apparatus is also provided with the mechanism for cutting off the driving of the transfer device and the contact thereof with the image supporting member. A jam can thus be dealt with by only the simple operation of pulling out the transfer material in the peripheral direction of the transfer device. In addition, since a jam can be dealt with only by pulling out the transfer material in the peripheral direction of the transfer device, it is possible to prevent the accident that the surface of the transfer device is damaged by the operator's hands. Further, the addition of the mechanism for indicating an opening position and the mechanism for releasing the pressure between the fixing rollers in linkage to the opening operation permits more simple and rapid dealing with a jam and prevents the scattering of the unfixed developer, which is caused by the breakage of the jammed transfer material, thereby constantly obtaining high-quality images.

Each of the above-described embodiments concerns as an example a color image forming apparatus which is capable of forming full-color images. Although the present invention is of course effective for such a full-color image forming apparatus, as described above, the invention is not limited to this apparatus. For example, the present invention can be applied to an image forming apparatus without the transfer member which is capable of forming single-color images only. Even when the invention is applied to the full-color image forming apparatus, the full-color image forming process is not limited to the above-described one, and the process can be appropriately selected. In addition, the fixing means is not limited to the above-described fixing device, and for example, a pressure fixing device may be used.

The process cartridge comprises the image supporting member such as an electrophotographic photosensitive member or the like, and at least one of the process means such as the charge means, the development means, the cleaning means and the like, which are incorporated in the cartridge. The process cartridge is detachably mounted on the image forming apparatus. Specifically, the process cartridge comprises the charge means, the development means or the cleaning means and the electrophotographic photosensitive member, both of which are incorporated into the cartridge, and the cartridge is detachably fitted to the image forming apparatus (for example, a copying machine, a facsimile equipment, LBP or the like). Alternatively, the process cartridge may comprise at least one of the charge means, the development means and the cleaning means and the electrophotographic photosensitive member, which are incorporated into the cartridge, and the cartridge is detachably fitted to the image forming apparatus (for example, a copying machine, a facsimile equipment, LBP or the like). The process cartridge may comprise at least the development means and the electrophotographic photosensitive member, both of which are incorporated into the cartridge, and the cartridge is detachably fitted to the image forming apparatus (for example, a copying machine, a facsimile equipment, LBP or the like).

However, the present invention is not limited to an image forming apparatus which uses the process cartridge, and the invention can be of course applied to an image forming apparatus without the process cartridge.

As described above, the present invention provides an image forming apparatus in which the properties of the operation of dealing with a jam are significantly improved.

What is claimed is:

1. An image forming apparatus for forming images on a recording medium, said image forming apparatus comprising:

image forming means for forming an image on the recording medium;

a conveyance passage for conveying the recording medium such that said image forming means forms an image thereon;

a stationary first casing having a portion of said conveyance passage;

a second casing having a portion of said conveyance passage and being openable relative to said stationary first casing so as to provide access therebetween; and a third casing having a portion of said conveyance passage, having a portion adjacent to said stationary first casing, and having a portion adjacent to said second casing, wherein said third casing and said second casing are openable relative to said stationary first casing together as a unit, and said third casing is openable relative to said stationary first casing and relative to said second casing, independently of whether said second casing has been opened relative to said stationary first casing.

2. An image forming apparatus according to claim 1, wherein said image forming means comprises an electrophotographic photosensitive member.

3. An image forming apparatus according to claim 1, wherein said image forming means comprises an exposure device for applying image light to an electrophotographic photosensitive member.

4. An image forming apparatus according to claim 3, wherein said exposure device comprises a polygon mirror and a laser diode for applying image light to said polygon mirror in accordance with an image signal.

5. An image forming apparatus according to claim 1, wherein said image forming means comprises charge means for charging an electrophotographic photosensitive member.

6. An image forming apparatus according to claim 1, wherein said image forming means comprises cleaning means for removing toner remaining on an electrophotographic photosensitive member.

7. An image forming apparatus according to claim 1, wherein said image forming means comprises transfer means for transferring a toner image on an electrophotographic photosensitive member to the recording medium.

8. An image forming apparatus according to claim 1, wherein said image forming means comprises fixing means for fixing a toner image transferred to the recording medium thereto.

9. An image forming apparatus according to claim 1, wherein said conveyance passage extends from container means for the recording medium to a discharge portion for receiving the recording medium when the recording medium is discharged from the apparatus after image formation, wherein said passage passes through a transfer region for transferring the image on said image forming means to the recording medium and through fixing means for fixing the image transferred to the recording medium in said transfer region.

10. An image forming apparatus according to claim 1, wherein said stationary first casing comprises a portion of said conveyance passage extending from a feed cassette for supplying the recording medium to an image transfer region, a mounting portion for a process cartridge, and an exposure means.

11. An image forming apparatus according to claim 1, wherein said second casing comprises a portion of said conveyance passage ranging from an image transfer region to a separation region, a transfer member, and a separation charger.

12. An image forming apparatus according to claim 1, wherein said third casing comprises a fixing device, a portion of said conveyance passage ranging from a transfer member to a discharge portion through said fixing device, and at least one discharge roller.

13. An image forming apparatus according to claim 1, further comprising a process cartridge detachably fitted thereto, said cartridge having incorporated therein at least one of a charge means, a development means, and a cleaning means and having an electrophotographic photosensitive member.

14. An image forming apparatus according to claim 13, wherein said process cartridge comprises development means, said development means comprising a plurality of development units for developing, with different colors, a latent image formed on the electrophotographic photosensitive member.

15. An image forming apparatus according to claim 1, further comprising a process cartridge detachably fitted thereto, said cartridge having incorporated therein at least one of a charge means, a development means, a cleaning means, and an electrophotographic photosensitive member.

16. An image forming apparatus according to claim 15, wherein said process cartridge comprises development means, said development means comprising a plurality of development units for developing, with different colors, a latent image formed on the electrophotographic photosensitive member.

17. An image forming apparatus according to claim 1, further comprising a process cartridge detachably fitted thereto, said cartridge having incorporated therein at least a development means and an electrophotographic photosensitive member.

18. An image forming apparatus according to claim 17, wherein said development means comprises a plurality of development units for developing, with different colors, a latent image formed on the electrophotographic photosensitive member.

19. An image forming apparatus according to claim 1, wherein transmission of a driving force to a transfer member, which holds the recording medium on the peripheral surface thereof under rotation to perform multiple transfers onto the recording medium, is interrupted in response to an opening operation of said second casing relative to said stationary first casing.

20. An image forming apparatus according to claim 1, wherein said image forming apparatus comprises an electrophotographic copying machine.

21. An image forming apparatus according to claim 1, wherein said image forming apparatus comprises a laser beam printer.

22. An image forming apparatus according to claim 1, wherein said image forming apparatus comprises a facsimile device.

23. An image forming apparatus according to claim 1, wherein said image forming apparatus is usable with a photosensitive drum, and wherein said image forming means comprises development means for developing a latent image formed on the photosensitive drum.

24. An image forming apparatus according to claim 23, wherein said development means comprises a plurality of development units for developing, with different colors, the latent image.

25. An image forming apparatus for forming an image on a transfer material by transferring a toner image formed on an image supporting member to the transfer material conveyed by a transfer device, separating the transfer material to a fixing device, and then fixing the image on the transfer material, said image forming apparatus comprising:

a stationary first portion;

a second portion at which the transfer material is conveyed by the transfer device, said second portion openable relative to said stationary first portion so as to provide access therebetween; and a third portion at which the transfer material is conveyed to the fixing device after being separated from the transfer device, said third portion having a portion adjacent to said stationary first portion and a portion adjacent to said second portion, wherein said second portion and said third portion are openable relative to said stationary first portion together as a unit by rotating said second portion about a first rotational shaft which intersects the direction of conveyance of the transfer material at a right angle, said third portion is openable relative to said stationary first portion and relative to said second portion by rotating said third portion about a second rotational shaft which intersects the direction of conveyance of the transfer material at a right angle, independently of whether said second portion has been opened relative to said stationary first portion, and wherein the driving of the transfer device is released in response to an opening operation of at least one of said second portion and said third portion.

26. An image forming apparatus according to claim 25, wherein the driving of the transfer device is released in response to an opening operation of said third portion alone.

27. An image forming apparatus according to claim 25, wherein the image supporting member comprises a photosensitive drum and wherein the transfer device rotates a plurality of times and each rotation transfers a different color toner image from the photosensitive drum onto the transfer material.

28. An image forming apparatus for forming image on a recording medium, said image forming apparatus comprising:

image forming means for forming an image on the recording medium;

a conveyance passage for conveying the recording medium such that said image forming means forms an image thereon;

a development casing, including development means and having a portion of said conveyance passage;

a transfer casing, including recording medium transfer means and a portion of said conveyance passage and being openable relative to said development casing so as to provide access therebetween; and a fixing portion casing, including image fixing means and a portion of said conveyance passage and having a portion adjacent to said development casing and a portion adjacent to said transfer casing, said transfer casing and said fixing portion casing being openable relative to said development casing together as a unit, and said fixing portion casing being openable relative to said development casing and relative to said transfer casing, independently of whether said transfer casing has been opened relative to said development casing.

29. An image forming apparatus according to claim 28, wherein said image forming apparatus is usable with a photosensitive drum and wherein said development means comprises a plurality of development units for developing, with different colors, a latent image formed on the photosensitive drum.

30. An image forming apparatus, usable with a process cartridge and a feed cassette, for forming images on a recording medium, said image forming apparatus comprising:

image forming means for forming an image on the recording medium;

a conveyance passage for conveying the recording medium such that said image forming means forms an image thereon;

a stationary first casing comprising a portion of said conveyance passage extending from the feed cassette for supplying the recording medium to an image transfer region, a mounting portion for the process cartridge, and exposure means;

a second casing, openable relative to said stationary first casing so as to provide access therebetween, comprising a portion of said conveyance passage ranging from an image transfer region to a separation region, a transfer member, and a separation charger; and a third casing, openable together as a unit with said second casing relative to said stationary first casing and openable relative to said second casing and relative to said stationary first casing, independently of whether said second casing has been opened relative to said stationary first casing, comprising a fixing device, a portion of said conveyance passage ranging from said transfer member to a discharge portion through said fixing device, and at least one discharge roller, and having a portion adjacent to said second casing and a portion adjacent to said stationary first casing.

31. An image forming apparatus according to claim 30, further comprising a process cartridge detachably fitted thereto, said process cartridge having incorporated therein at least one of charge means, development means, and cleaning means and having an electrophotographic photosensitive member.

32. An image forming apparatus according to claim 31, wherein said process cartridge comprises development means, said development means comprising a plurality of development units for developing, with different colors, a latent image formed on the electrophotographic photosensitive member.

33. An image forming apparatus according to claim 30, further comprising a process cartridge detachably fitted thereto, said process cartridge having incorporated therein at least one of charge means, development means, cleaning means, and an electrophotographic photosensitive member.

34. An image forming apparatus according to claim 33, wherein said process cartridge comprises development means, said development means comprising a plurality of development units for developing, with different colors, a latent image formed on the electrophotographic photosensitive member.

35. An image forming apparatus according to claim 30, further comprising a process cartridge detachably fitted thereto, said process cartridge having incorporated therein at least development means and an electrophotographic photosensitive member.

36. An image forming apparatus according to claim 35, wherein said development means comprises a plurality of development units for developing, with different colors, a latent image formed on the electrophotographic photosensitive member.

* * * * *

UNITED STATES PATENT AND TRADEMARK OFFICE

CERTIFICATE OF CORRECTION

PATENT NO. : 5,517,281

DATED : May 14, 1996

INVENTOR(S) : TOSHIAKI MIYASHIRO, ET AL.

It is certified that error appears in the above-indentified patent and that said Letters Patent is hereby corrected as shown below:

ON THE COVER PAGE

Item [54] "IMAGE FORMING APPARATUS FEATURING A PLURALITY OR RELATIVELY MOVEABLE CASINGS" should read --IMAGE FORMING APPARATUS FEATURING A PLURALITY OF RELATIVELY MOVEABLE CASINGS--.

COLUMN 1

Line 2, "OR" should read --OF--; and
Line 44, "a" (first occurrence) should read --an--.

COLUMN 2

Line 53, "one" should read --area--; and
Line 64, "apparats" should read --apparatus--.

COLUMN 13

Line 42, "is" should read --will--.

Signed and Sealed this

First Day of October, 1996

*Attest:*

Bruce Lehman

BRUCE LEHMAN

*Attesting Officer*

*Commissioner of Patents and Trademarks*